US005852764A

United States Patent [19]

Kida et al.

[11] Patent Number: 5,852,764

[45] Date of Patent: Dec. 22, 1998

[54] SHEET POST-PROCESSING APPARATUS

[75] Inventors: Hiroshi Kida, Yamatokoriyama; Syoichiro Yoshiura, Tenri, both of Japan

[73] Assignee: Sharp Kabushiki Kaisha, Osaka, Japan

[21] Appl. No.: 855,216

[22] Filed: May 13, 1997

[30] Foreign Application Priority Data

May 30, 1996 [JP] Japan ..... 8-136529
May 14, 1996 [JP] Japan ..... 8-119315

[51] Int. Cl.[6] ..... G03G 15/00

[52] U.S. Cl. ..... 399/401; 399/402; 399/405; 271/298; 271/288

[58] Field of Search ..... 399/401, 402, 399/405, 407; 271/288, 298, 184, 186, 301, 303, 305, 176, 265.01, 265.02, 188

[56] References Cited

U.S. PATENT DOCUMENTS 4,787,616 11/1988 Sasaki et al. ..... 271/176 X
4,945,390 7/1990 Hasegawa et al. .
4,958,828 9/1990 Saito ..... 271/186
5,166,739 11/1992 Katsuki et al. .

FOREIGN PATENT DOCUMENTS 4-247993 9/1992 Japan .
5-310357 11/1993 Japan .
7-137909 5/1995 Japan .

*Primary Examiner*—Matthew S. Smith
*Attorney, Agent, or Firm*—Dike, Bronstein, Roberts & Cushman; David G. Conlin; George W. Neuner

[57] ABSTRACT

A sheet is discharged from an image forming apparatus either onto a first discharge tray through a first transport path by sheet entry rollers via first transport rollers without being reversed, or onto a second discharge tray by second discharge rollers as being guided to a branched transport path by a first switching member formed in a midpoint of the transport path and further guided to a second transport path by a second switching member. The first and second transport rollers are capable of rotating in a reverse direction, and the sheet being fed to the first discharge tray is transported by the second transport rollers after being reversed to be discharged onto the first discharge tray in a reversed state. Therefore, in response to an image forming mode, a discharge end of the sheet and a discharge state of the sheet can be set as desired. In the case of discharging the sheet in a reversed state, as the first or second discharge tray can be used as a switch back transport path, the sheet post-processing apparatus can be reduced in size.

20 Claims, 20 Drawing Sheets

| DISCHARGING END TRAY | REVERSE | MODE |
|---|---|---|
| 1 | YES | MODE C |
| 1 | NO | MODE A |
| 2 | YES | MODE B |
| 2 | NO | MODE D |

SHEET POST-PROCESSING APPARATUS

FIELD OF THE INVENTION

The present invention relates to a sheet post-processing apparatus provided in a discharge section of an image forming apparatus such as a digital copying machine, etc., available on the market, for discharging a printing material (sheet) having an image formed thereon being fed from the discharge section after aligning it in proper page order.

BACKGROUND OF THE INVENTION

Recently, there are digital copying machines available on the market, provided with not only a normal copy mode in which a document image read by a reading section of the copying machine is printed on a sheet, but also a printer mode, a fax mode, etc., in which image data received from an external processing device are printed. In such digital copying machines, in the printer mode, image data are received from an external data processing device such as a computer (including a personal computer), a word processor, etc., and the image data as received are printed on the sheet as an image. In the fax mode, the image data are received from an external communication device through communication means such as a telephone line, etc., and the image data as received are printed on the sheet.

Generally, in the described digital copying machine, in the normal copy mode, sheets are sequentially discharged with an image forming surface facing upwards (face up state); while in the printer mode or the fax mode, sheets are discharged with an image forming surface facing downwards (face down state).

Namely, in the normal copy mode, an automatic document feeder placed on the digital copying machine is used, and the image is sequentially read by the reading section of the copying machine from the last page of the document in consideration of the discharging page order of the sheets having images formed thereon. As a result, a printed material of the document image (sheet having an image formed thereon) can be discharged in proper page order of the document.

On the other hand, when the digital copying machine functions as a printer, or a fax machine, image data are generally sent sequentially from the top page of the original document from an external apparatus such as a personal computer, a word processor, a facsimile, etc. Therefore, when printing the image data as received on the upper surfaces of the sheets and stacking the sheets sequentially discharged from the discharge section on the discharge tray in the face up state, the copied material is output in reversed page order.

To eliminate the described problem, an arrangement of aligning the printed sheets in proper page order by reversing the sheet being discharged in the described state so that the sheets are stacked with the image forming surface facing downwards on the discharge section has been proposed.

Such discharge processing function is enabled, for example, by Japanese Unexamined Patent Publication No. 310357/1993 (Tokukaihei 5-310357). The structure of the image forming apparatus disclosed in the above Gazette will be briefly explained. Namely, in the image forming apparatus, when a toner image on a photoreceptor is transferred onto a sheet being sent from a feed tray, the sheet is discharged out of the apparatus via a fuser. The apparatus is provided with a discharge processing unit for switching a sheet discharge state according to a mode selected, i.e., a copy mode or a printer mode.

When the image forming apparatus is set in the copy mode, a sheet is discharged with an image forming surface facing upwards onto a discharge tray through a discharge opening via a predetermined transport path in a discharge processing unit. On the other hand, in the printer mode, the transport path is switched, and the sheet is once guided to a switch back transport path via a predetermined transport path, and thereafter, the transport direction is switched so that the sheet is discharged with the image forming surface facing downwards through the discharge opening onto another discharge tray formed below the above-mentioned discharge tray.

As switch means for switching a transport path for the sheet, the arrangement where a switching member is placed along the transport path to switch ON/OFF a solenoid has been proposed. Namely, the switching member formed at a junction of the transport path is driven by switching ON/OFF the solenoid, and one of two transport paths is closed at the junction to guide the sheet to the other transport path.

Japanese Unexamined Patent Publication No. 247993/1992 (Tokukaihei 4-247993) discloses a digital copying machine provided with a sheet post-processing apparatus for stapling sheets having document images or images received from the facsimile formed thereon. In the image forming apparatus of the described Gazette, first, a toner image formed on the surface of the photoreceptor is transferred onto a sheet fed from any one of the feed cassettes in a transfer section. Then, the sheet having a toner image formed thereon is sequentially fed onto a predetermined tray provided in the sheet post-processing apparatus, that is selected according to a mode, via the fuser.

In the image forming apparatus of the described Gazette, a both-sided unit for printing on both sides is formed so as to be detachable from or integral with the main body of the digital image forming apparatus. By forming the both-sided unit in the digital image forming apparatus, an image can be printed on both sides of the sheet. Namely, in the case of printing an image on both sides of the sheet, the sheet is fed into the both-sided unit via the switch back transport path in the both-sided unit, and further to the transfer position at which the toner image is formed again.

In this case, the sheet having an image formed on one side is fed inside the both-sided unit via the switch back transport path, and thus the sheet to be fed into the both-sided unit is reversed. Therefore, a new image is formed on the back surface of the sheet that is fed again to the transfer position of the photoreceptor.

According to the image forming apparatus of the described Gazette, in the fax mode, it is determined if the image data as received is composed of a plurality of pages. If image data of one page are received, it is set to a single-sided mode, while if image data of a plurality of pages are received, it is set to a both-sided mode. If the both-sided copy mode is selected, images on pages of even numbers are formed on the first surfaces of the sheets, and the transport direction of the sheets having images formed thereon is switched at the switching member via the fuser, and the sheets are further guided to the switch back transport path. By reversing the transport direction of the sheets at the switch back transport path, the sheets having images formed thereon are fed onto the both-sided tray with an image forming surface facing upwards. As a result, on the both-sided tray, sheets having images on pages of even numbers are stacked from the bottom in the order of page 2, page 4, page 6, . . .

Upon completing the printing of the images on pages of the even numbers, sheets fed from the both-sided tray are fed again from the last page to a regist roller. As a result, images on pages of odd numbers are sent to the transfer section to form images. In this case, an image on the n-1 page is formed on the back surface of the sheet having an image of the last page n (even number) formed thereon, and an image of the n-3 page is formed on the back surface of the sheet having an image of the n-2 page formed thereon. The sheets having images as received formed on both surfaces are sequentially discharged via the fuser with pages of odd numbers facing upwards onto a predetermined tray of the sheet post-processing apparatus.

The sheets having images as received printed thereon are stacked from the last page, and sheets thus stacked are stapled upon completing a printing of a set of received image to form a bound set of sheets.

When adopting the described sheet post-processing apparatus, it is required to have the switch back transport path for switching the transport direction of sheets having images formed thereon and the mechanism to achieve the described function inside the digital image forming apparatus.

Therefore, the image forming apparatus becomes larger in size, thereby presenting the problem with regard to a space required in the office. Furthermore, the switch back transport path, which permits the maximum size sheet that can be processed by the image forming apparatus to be reversed, and the sheet transportation mechanism are required, thereby presenting the problem that the apparatus becomes larger in size which is economically disadvantageous.

Moreover, in the sheet post-processing apparatus, irrespectively of an image forming mode selected among various image forming modes, the sheet having an image formed thereon is discharged at a predetermined position. For example, in the fax mode, as the sheet is discharged with an image forming surface facing downwards, the sheet having an image formed thereon is discharged to a lower discharge tray. Namely, as it is considered that the image forming apparatus functions mainly as the copying machine, the upper discharge tray is always used as the discharge tray for a copying machine.

Therefore, in the case where the image forming apparatus is mainly used as a fax, a printer, etc., if sheets having images formed thereon are discharged onto the lower discharge tray, it is difficult to remove the discharged sheets as being hidden by the upper discharge tray. Namely, in the arrangement where sheets having images formed thereon by the fax or printer that is used frequently are discharged always on the lower discharge tray, as the sheet needs to be removed frequently, a burden incurred on the operator increases.

If it is arranged such that sheets are discharged onto the same discharge tray between the fax mode and the printer mode, discharged sheets are mixed on the discharge tray. Thus, the operator is required to perform such troublesome work of classifying the mixed sheets.

In the image forming apparatus of Japanese Unexamined Patent Publication No. 247993/1992 (Tokukaihei 4-247993), when reading images as received by the fax machine from the memory, it is required to print the received images on sheets so that the order of the sheets to be stored on the staple processing tray of the post-processing apparatus can be taken into consideration. This may often cause a sheet transportation deficiency, and, for example, in the event of a paper jam, a complicated process is required for its recovery.

Moreover, as a memory for storing the received image on all pages from the fax machine is required, not only that a memory of a large capacity but also control means of a complicated structure, such as address means for recognizing the state of such memory medium, etc., are required, thereby raising the problem of cost increase.

SUMMARY OF THE INVENTION

It is a first object of the present invention to provide a sheet post-processing apparatus which permits a reduction in size of an apparatus main body by eliminating a need of additional space for a switch back transportation in the case of discharging a sheet having an image formed thereon after being reversed, and a reduction in burden of an operator by selecting a sheet discharge end as desired.

In order to achieve the first object of the present invention, the sheet post-processing apparatus which receives a sheet having an image formed thereon, that is discharged from an image forming apparatus according to page order, is arranged so as to include: first and second discharge trays being provided in a number of at least two, a first transport path for guiding to the first discharge tray the sheet having an image formed thereon discharged through a sheet discharge opening of the image forming apparatus, a branched transport path being branched from the first transport path, a second transport path connected to the branched transport path, for guiding the sheet having an image formed thereon to the second discharge tray, sheet transport means for transporting a sheet being transported in each transport path between a normal direction and a reverse direction, and a transport path switching member for switching the transport path for the sheet, the transport path switching member being provided at a junction between the first transport path and the branched transport path.

According to the described sheet post-processing apparatus, sheets being transported through the first and second transport paths can be discharged directly onto respective discharge trays without being reversed. On the other hand, a transport direction of the sheets can be reversed by the transport means. Therefore, by using the first and second transport paths as the switch back transport path, the sheets can be discharged onto respective trays in a reversed state.

For example, the sheet being discharged from the image forming apparatus is first transported to the first discharge tray, and when the rear end of the sheet passes the junction between the first transport path and the branched transport path, the transport direction of the transport means is reversed. Then, the sheet being transported in a reverse direction is discharged onto the second discharge tray via the branched transport path and the second transport path. Additionally, the transport path switching member switches the transport path in such a manner that the sheet discharged from the image forming apparatus is guided towards the first discharge tray, while the sheet being transported in a reverse direction from the first discharge tray is guided to the branched transport path. Here, the sheet being discharged onto the second discharge tray is once switched back to the first discharge tray. Therefore, the sheet faces the opposite side from the sheet being transported directly to the second discharge tray from the image forming apparatus. As a result, the described sheet post-processing apparatus permits a sheet to be discharged onto a discharge tray in a state as desired.

As described, one of the discharge trays can be selected as desired according to a selected image forming mode of the image forming apparatus, and a sheet can be discharged onto the discharge tray as selected according to the image forming mode. For example, in the case where the sheet is discharged without being reversed, the sheet is discharged directly onto the discharge tray as selected. Additionally, in the case of discharging the sheet in a reversed state, the sheet is once switched back using other discharge tray than that selected as the discharge end, and then discharged onto the discharge tray selected as the discharge end.

As a result, irrespectively of whether or not the sheet is discharged in a reversed state, the sheet to be output in the image forming mode that is used frequently, can be discharged onto, for example, the upper discharge tray that is well observable by the operator, thereby reducing the burden of the operator.

Additionally, it is permitted to specify the discharge end according to the image forming mode set in the image forming apparatus, and the described burden of the operator of classifying the sheets having an image formed thereon that are mixed can be eliminated.

In the described sheet post-processing apparatus, the discharge end suited for the copy mode can be set as desired, i.e., whether image data from the external section is output as a hard copy, or the image data as read by the image reading means in the image forming apparatus main body is output as a hard copy. Namely, in the copy mode, as the operator generally stands by the image forming apparatus, it is preferable that the discharge end be selected so that the discharging state is observable from the operator.

Furthermore, the sheet post-processing apparatus permits a reduction in size of the apparatus as eliminating the needs of separately providing a sheet reversing section, i.e., a switch back mechanism by utilizing other discharge tray than the discharge tray of the discharge end for reversing the sheet.

It is a second object of the present invention to provide a sheet post-processing apparatus which permits a both-sided copying operation or a composite copying operation to be performed with ease.

In order to achieve the second object, the sheet post-processing apparatus which receives a sheet having an image formed thereon, that is discharged from an image forming apparatus according to page order, is arranged so as to include first and second discharge trays being provided in a number of at least two, a first transport path for guiding to the first discharge tray the sheet having an image formed thereon discharged through a sheet discharge opening of the image forming apparatus, a branched transport path being branched from the first transport path, a second transport path connected to the branched transport path, for guiding the sheet having an image formed thereon to the second discharge tray, the second transport path being connected to a retransport path that is used when the image forming apparatus carries out a double-sided copying operation or a composite copying operation, sheet transport means for transporting a sheet being transported in each transport path both in a normal direction and a reverse direction, a transport path switching member for switching a sheet transport path, the transport path switching member being provided at a junction between the first transport path and the branched transport path and a junction between the second transport path and the branched transport path, and control means for controlling the sheet discharge means and the transport path switching member in such a manner that a sheet is fed into the retransport path so that a next image is formed on the back surface of the surface on which the previous image is formed when the image forming apparatus carries out a double-sided copying operation, while a sheet is fed into the retransport path so that the next image is formed on the surface whereon the previous image is formed when the image forming apparatus carries out a composite copying operation on the same surface of the sheet.

According to the described sheet post-processing apparatus, when sending the sheet back to a retransport path in the both-sided copy mode, for example, the sheet being once switched back using the first or second discharge tray is transported to the retransport path. In this case, when carrying out an image forming process again on the sheet being transported to the retransport path, the image is formed on the back surface of the sheet, i.e., opposite to the surface on which the image is formed by the previous image forming process, thereby forming images on both sides of the sheet.

Additionally, when sending the sheet back to the retransport path in the composite copy mode, the sheet discharged from the image forming apparatus is transported directly to the retransport path via the branched transport path without via the first nor second discharge tray. Here, when performing an image forming process again on the sheet being transported to the retransport path, the image is formed on the same surface as the previous image forming surface, thereby performing a composite copying operation. As described, the described image forming apparatus of the present invention permits both-sided copying and composite copying operation to be performed with ease.

For a fuller understanding of the nature and advantages of the invention, reference should be made to the ensuing detailed description taken in conjunction with the accompanying drawings.

BRIEF DESCRIPTION OF THE DRAWINGS

FIG. 6(*b*) is a cross-sectional view showing a state where the first switching member is at the first switch position, and the sheet is being transported from the first discharge tray to the branched transport path;

FIG. 6(*c*) is a cross-sectional view showing a state where the first switching member is at the second switch position, and the sheet is being transported from the image forming apparatus to the branched transport path;

FIG. 6(*d*) is a cross-sectional view showing a state where the first switching member is at the second switch position, and the sheet is being transported from the branched transport path to the first discharge tray;

FIG. 7(*b*) is a cross-sectional view showing a state where the second switching member is at the first switch position, and the sheet is being transported from the second discharge tray to the retransport path;

FIG. 7(*c*) is a cross-sectional view showing a state where the second switching member is at the second switch position, and the sheet is being transported from the branched transport path to the retransport path;

FIG. 7(*d*) is a cross-sectional view showing a state where the second switching member is at the second switch position, and the sheet is being transported from the second discharge tray to the branched transport path;

DESCRIPTION OF THE PREFERRED EMBODIMENTS

The following descriptions will explain one embodiment of the present invention.

Figure 1:
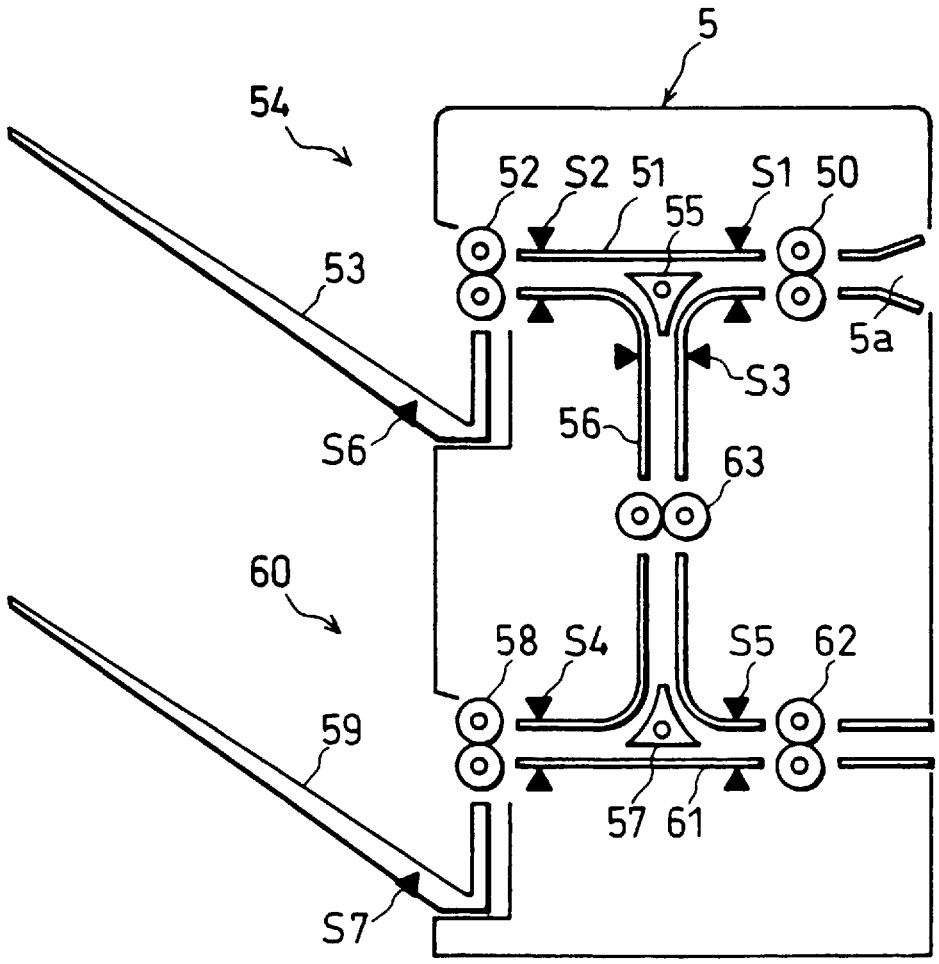
FIG. 1 is a cross-sectional view showing a structure of a sheet post-processing apparatus in accordance with one embodiment of the present invention.
Figure 2:
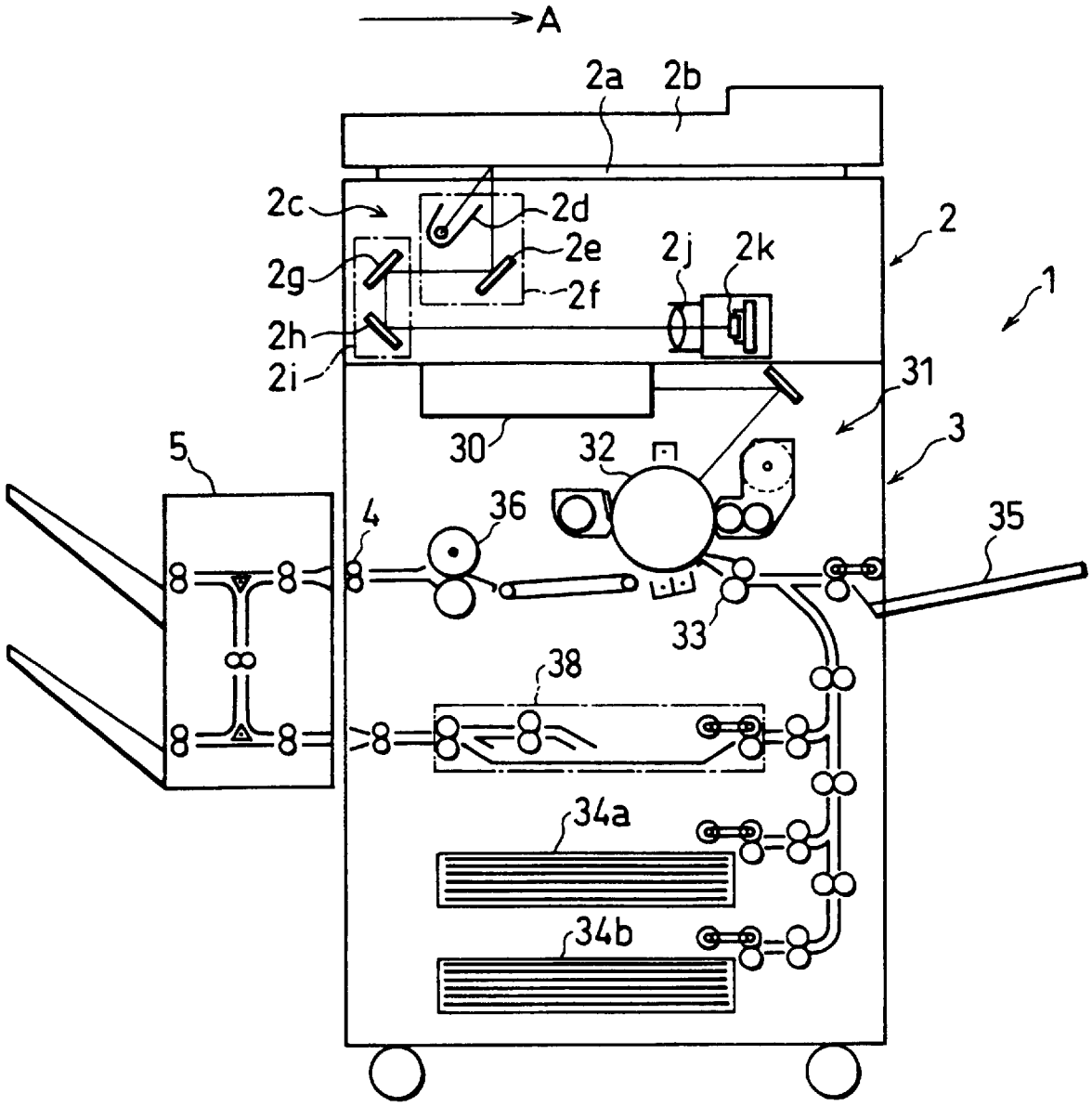
FIG. 2 is a cross-sectional view showing a structure of a digital copying machine provided with the sheet post-processing apparatus.

A sheet post-processing apparatus in accordance with the present embodiment is provided in a discharge section of a digital image forming apparatus having a copy mode, a printer mode, a fax mode, etc. An example of the sheet post-processing apparatus is shown in FIG. 1. An entire structure of the image forming apparatus provided with the sheet post-processing apparatus is schematically shown in FIG. 2.

First, the structure of the image forming apparatus will be explained in reference to FIG. 2. In the present embodiment, a digital copying machine is adopted as the image forming apparatus. The copying machine main body 1 of the digital copying machine is mainly composed of a scanner section 2 and a laser printing section (hereinafter referred to as a printer section) 3.

The scanner section 2 includes a document platen 2*a* made of transparent glass, a recirculating automatic document feeder (RADF) 2*b* for automatically feeding a document onto the document platen 2*a*, and a document image reading unit, i.e., a scanner unit 2*c*, for reading the image on the document placed on the document platen 2*a* by scanning. The document image read by the scanner section 2 is sent to an image data input section, to be described later, as read image data and undergoes a predetermined image process.

The RADF 2*b* is a device for automatically feeding to the document platen 2*a* of the scanner section 2, the document set on a predetermined document tray (not shown) at a time sheet by sheet. The RADF 2*b* includes a transport path for single-sided documents, a transport path for double-sided documents, and a transport-path switching mechanism, a sensor group for recognizing and controlling a state of the document being passed through each section and a control section, etc., so that one side or both sides of documents is/are read by the scanner unit 2 according to a selection made by an operator. As to the R-ADF 2*b*, many applications have been filed, and there are a variety of RADFs 2*b* available on the market, and thus further explanations thereof shall be omitted here.

The scanner unit 2*c* for reading an image on the document placed on the document platen 2*a* includes a lamp reflector assembly 2*d* for exposing the surface of the document, a first scanning unit 2*f* having a first reflecting mirror 2*e* placed thereon for reflecting light reflected from the document for guiding the reflected image from the document to a photoelectric transfer element (CCD), a second scanning unit 2*i* having a second reflecting mirror 2*g* and a third reflecting mirror 2*h* for guiding the reflected image from the first scanning unit 2*f* to the photoelectric transfer element (CCD), an optical lens 2*j* for forming a reflected light image from the document on the photoelectric transfer element (CCD), and the CCD element 2*k*, to be described later, for converting the reflected light image from the document into an electric image signal.

The scanner section 2 successively places documents on the document platen 2*a* by operations incorporating the RADF 2*b* and the scanner unit 2*c*, and moves the scanner unit 2*c* along the bottom surface of the document platen 2*a* so as to read the image on the document sequentially placed on the document platen 2*a*. Especially, the first scanning unit 2*f* scans at a constant velocity V in a direction of an arrow A shown in FIG. 2 along the document platen 2*a*, and the second scanning unit 2*i* controls so as to scan in the same and parallel direction at a velocity of V/2. As a result, the document image is read by sequentially forming an image on the document placed on the document platen 2*a* of the CCD element 2*k* line by line.

The read image data resulting from reading an image on the document by the scanner unit 2*c* is sent to an image processing section, to be described later, to be temporarily stored in a memory of the image processing section after various processing have been applied. Then, the image data in the memory is read out according to an output instruction, and then transferred to the printer section 3, to form an image on a printing sheet. The printer section 3 includes a sheet transport system for transporting a sheet, i.e., a recording material, for forming thereon an image, a laser writing unit 30 and an electrophotographic processing unit 31 for forming thereon an image.

The laser writing unit 30 includes a semiconductor laser source for emitting laser light according to the image data read by the scanner unit 2*c* or the image data transferred from an external device, a polygon mirror for deflecting the laser light at a constant angular velocity, and an f·θ lens for correcting the laser light deflected by the polygon mirror to be deflected at a constant velocity on a photoreceptor drum 32 of the electrophotographic processing section 31.

The electrophotographic processing section 31 includes the photoreceptor drum 32. The electrophotographic processing section 31 further includes a charger, a developing unit, a transfer unit, a separating unit, a cleaning unit, and a charge removing unit which are placed along the outer surface of the photoreceptor drum 32 in a known manner, and an image is formed on a sheet by controlling these members.

On the other hand, the sheet transport system includes a transport section 33 for transporting a sheet to the electrophotographic processing section 31 for forming an image, particularly to the portion where the transfer unit is placed, feeding cassettes 34*a* and 34*b* for feeding the sheet to the transport section 33, a manual feeder 35 for feeing a sheet of a size as desired, a fuser 36 for making a transferred image, particularly a toner image, to be affixed onto the sheet, and a retransport path 38 for feeding the sheet having an image formed on the same surface or on the back surface of the sheet again after undergoing the fixing process. On the downstream side of the fuser 36, provided is a sheet post-processing apparatus 5 for receiving a sheet having an image printed thereon and for applying a predetermined process on the sheet.

In the laser writing unit 30 and the electrophotographic processing section 31, the image data read from the image memory is formed into an electrostatic latent image formed on the surface of the photoreceptor drum 32 by scanning with a laser beam emitted from the semiconductor laser light source of the laser writing unit 30 to be projected onto the photoreceptor drum 32 of the electrophotographic processing section 31. The electrostatic latent image is visualized by making the toner adhered thereto by the developing unit. The resulting visualized toner image on the surface of the photoreceptor drum 32 is electrostatically transferred onto one surface of the sheet being fed from either one of the feeding cassette 34*a* or 34*b* of the described multi-level feed units or the manual feeder 35, and the transferred image is made permanent onto the sheet by the fuser 36.

The sheet having an image formed thereon is fed into the sheet processing unit 5 from the fuser 36 through the discharge rollers 4.

[Circuit in the Image Processing Section]

Next, with respect to the described digital copying machine, the structure and the functions of the image processing section for processing document image data as read will be explained.

Figure 3:
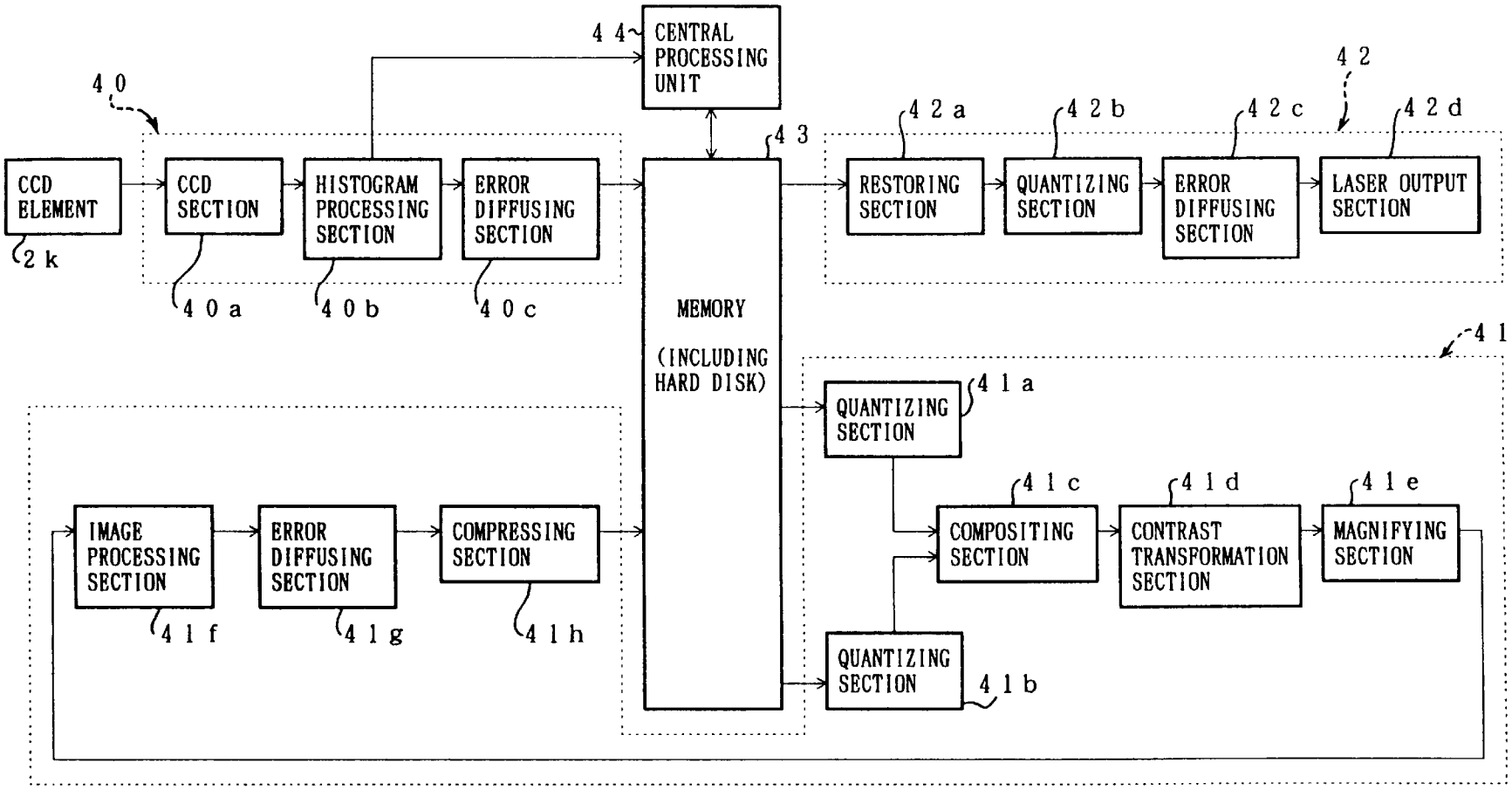
FIG. 3 is a block diagram showing a circuit structure in a digital image processing section of the digital copying machine.

FIG. 3 is a block diagram of the image processing section formed in the digital copying machine of FIG. 2. The image processing section includes an image data input section 40, an image processing section 41, an image data output section 42, a memory 43 composed of a RAM (random access memory) and a hard disk, etc., and a central processing unit (CPU) 44.

The image data input section 40 includes a CCD section 40*a*, a histogram processing section 40*b* and an error diffusing section 40*c*. The image data input section 40 converts the document image data into binary data by the photoelectric converter, and processes the image data by an error diffusing method while making a histogram as binary digital quantity. The processed data by the image data input section 40 is then temporarily stored in the memory 43.

In the CCD section 40*a*, analog signals representing the densities of pixels of the image data are converted into digital signals by the A/D conversion. Thereafter, digital signals are corrected by the MTF (modulation transfer function) correction, the black-and-white level correction, or the gamma correction. Then, (8-bit) digital signals representing 256 tones are transmitted to the histogram processing section 40*b*.

In the histogram processing section 40*b*, the digital signal output from the CCD section 40*a* is added according to the pixel densities of 256 tones so as to obtain density information (histogram data). The density information is sent as pixel data to the error diffusing section 40*c*, and to the CPU 44 if necessary.

In the error diffusing section 40*c*, the 8-bit/pixel digital signal output from the CCD section 40*a* is converted into 1-bit (binary) digital signal, and a re-allocation is performed for faithfully reproducing the densities of local portions of the document according to the error diffusing method. The error diffusing method is a type of pseudo-halftone processing, and an error caused by the conversion to one bit is reflected when converting adjacent pixel into one bit.

The image data processing section 41 includes quantizing sections 41*a* and 41*b*, a compositing section 41*c*, a contrast transformation section 41*d*, a magnifying section 41*e*, an image processing section 41*f*, an error diffusing section 41*g* and a compressing section 41*h*. The image data processing section 41 converts the input image data into image data of a form as desired by the operator. The image data processing section 41 processes the image data until all the image data have been converted into a final form as desired by the operator and stored in the memory 43. The described sections in the image data processing section 41 do not always perform their functions but perform their functions as the need arises.

The functions of the image processing section 41 will be explained in detail.

The image data converted into a one-bit form by the error diffusing section 40*c* is reconverted into 256 tones by the quantizing sections 41*a* and 41*b*.

In the compositing section 41*c*, a logical operation, i.e., logical OR, AND, or exclusive-OR operation is selectively carried out for each pixel. The data subjected to this operation is the image data stored in the memory 43 and bit data from a pattern generator (PG: not shown).

In the contrast transformation section 41*d*, the relationship between the output density and input density is freely determined based on a predetermined gradation transformation table with respect to the data representing 256 tones.

In the magnifying section 41*e*, interpolation is performed based on the known data input according to a selected magnification ratio so as to obtain pixel data (a density level) of target pixels after being magnified. Here, a magnification process is performed in a main scanning direction after executing a magnification process in a sub-scanning direction. As a result, an image is output in a magnification selected by the operator.

In the image processing section 41*f*, the input pixel data undergoes various image processing, and information is collected, for example, to extract features from data string.

The error diffusing section 41*g* performs a function similar to that of the error diffusing section 40*c* of the image data input section 40.

In the compressing section 41*h*, the one-bit data is compressed by run length encoding. If the image data has a final form of output image data, the compression of data is performed in the final processing loop.

The image data output section 42 includes a restoring section 42*a*, a quantizing section 42*b*, an error diffusing section 42*c* and a laser output section 42*d*. The image data output section 42 restores the compressed image data stored in the memory 43, reconverts the data into data representing 256 tones, converts the resulting data into two-bit data which give a smoother halftone image than one-bit data, and transmits the data to the laser output section 42*d*. The resulting image data is finally sent to the laser writing unit 30 of the laser printer section 3, thereby forming an image.

In the restoring section 42*a*, the image data compressed by the compressing section 41*h* is restored.

The quantizing section 42*b* performs processing in the same manner as in the quantizing sections 41*a* and 41*b* of the image data processing section 41.

The error diffusing section 42*c* performs processing in the same manner as in the error diffusing section 40*c* of the image data input section 40.

The laser output section 42*d* converts the digital image data into a laser ON/OFF signal according to the control signal from a sequence controller, not shown. The emission of the laser beam from the semiconductor laser in the laser writing unit 30 is controlled based on the ON/OFF signal, and an electrostatic latent image is formed on the photoreceptor drum 32.

The data processed in the image data input section 40 and the image data output section 42 are basically stored in the form of one-bit data in the memory 43 in order to save the memory capacity thereof. However, considering the degradation of the image data, the data may be stored in the form of two-bit data.

[Digital Copying Machine Controlling Mechanism]

Figure 4:
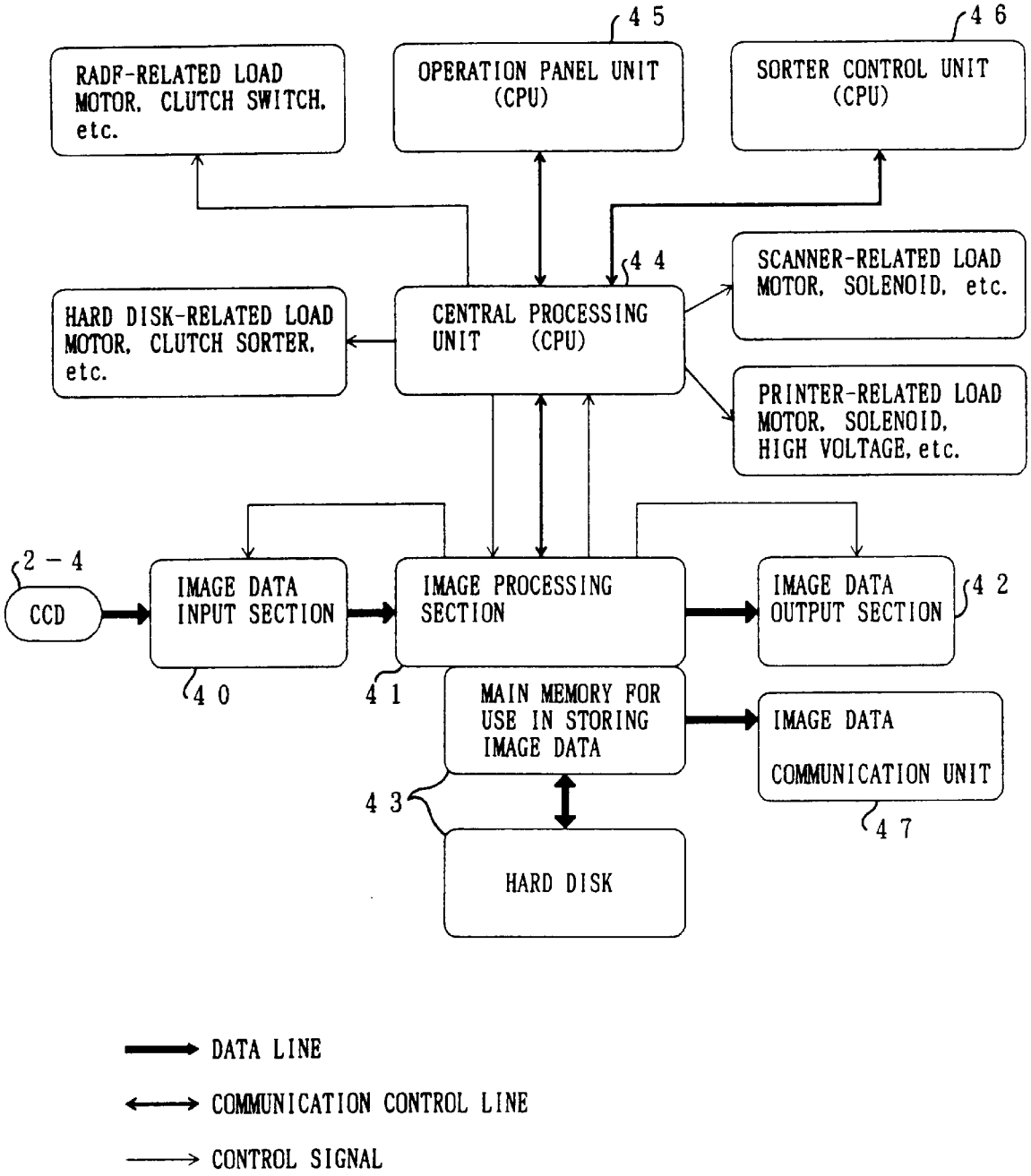
FIG. 4 is a block diagram showing a structure of essential parts of the digital copying machine.

FIG. 4 shows the state where respective members of the digital copying machine main body are controlled by the CPU 44.

The respective functions of the CCD element 2*k*, the image data input section 40, the image processing section 41, the image data output section 42, and the image memory 43 are the same as those of the sections shown in FIG. 3, and thus the descriptions thereof shall be omitted here.

The CPU 44 explained in reference to FIG. 3 controls the respective sections of the driving mechanism such as the RADF 2*b*, the scanner section 2, the printer section 3, etc., by the sequence control, and outputs control signals to the respective sections during control.

Further, to the CPU 44, connected is an operation panel unit 45 composed of an operation panel so as to allow communications between them. The operation panel unit 45 transfers a control signal to the CPU 44 according to a mode selected by the operator, thereby operating the digital copying machine main body 1 according to the set mode.

From the CPU 44, the control signal indicative of the operating state of the copying machine main body 1 is transferred to the operation panel unit 45. On the side of the operation panel unit 45, an operating state is sequentially displayed on a display section based on the control signal to show the current operating state to the operator.

A sorter control unit 46 is provided for controlling operations of the sheet post-processing apparatus for classifying the copied material to be discharged from the copying machine main body 1. Here, the sorter control unit 46 mainly controls the sheet post-processing apparatus 5 (see FIG. 2) in accordance with the present invention.

An image data communication unit 47 is provided so as to enable communication of the image data and the image control signal, etc., with other digital image forming apparatus.

Figure 5:
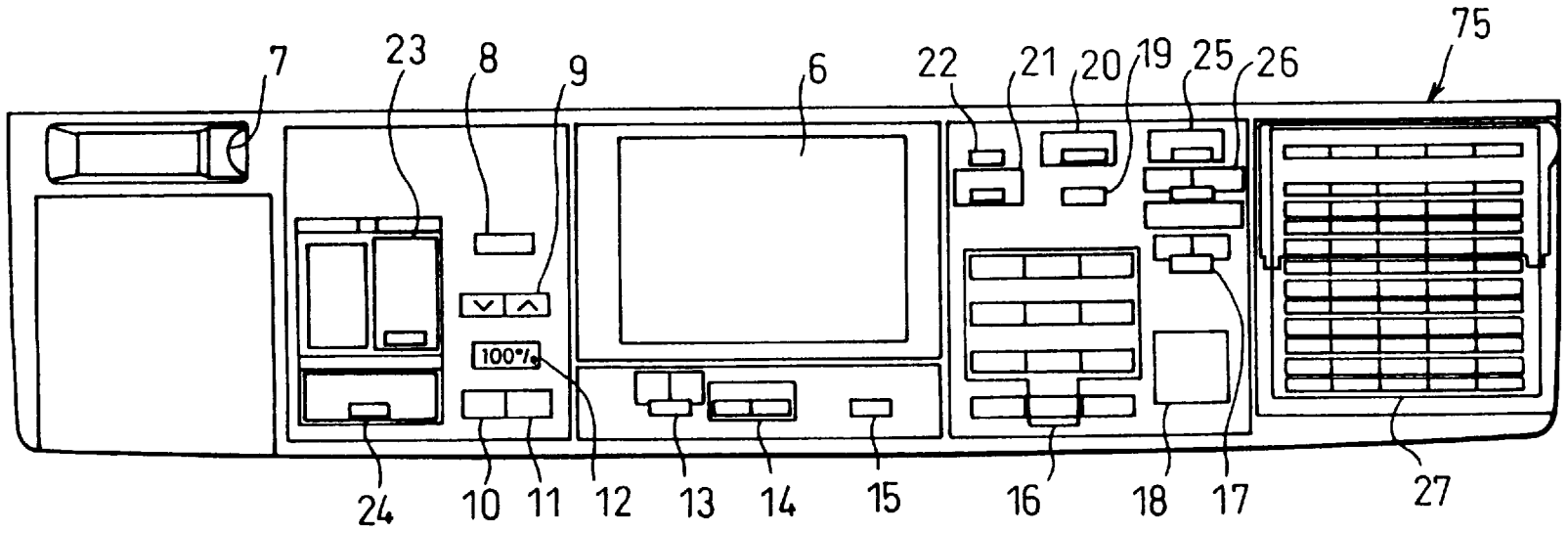
FIG. 5 is a plan view showing one example of an operation panel unit of the digital copying machine.
Figure 6C:
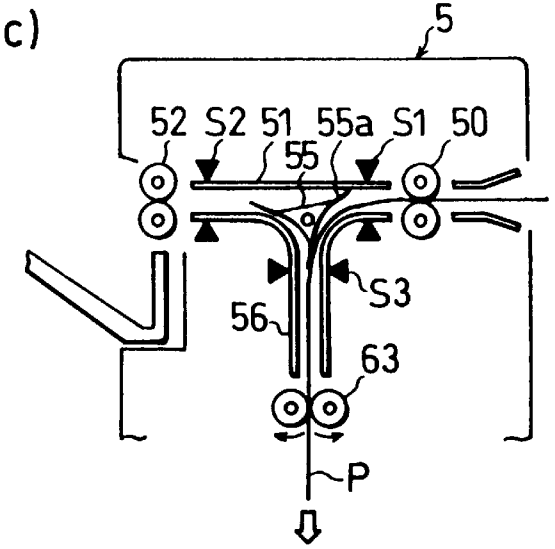
FIG. 6(*a*) is a cross-sectional view showing a state of switching a sheet transport path by the first switching member of the sheet post-processing apparatus shown in FIG. 1, wherein the first switching member is at the first switch position, and the sheet is being transported from the image forming apparatus to the first discharge tray.
Figure 6A:
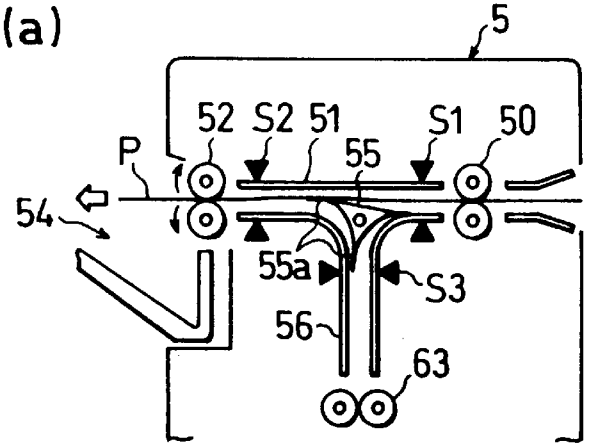
Figure 6D:
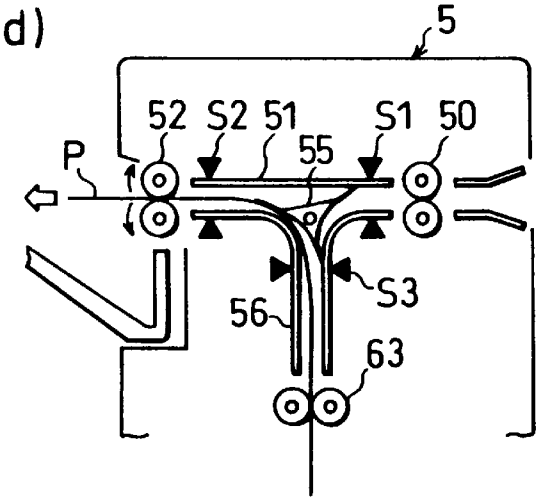
Figure 6B:
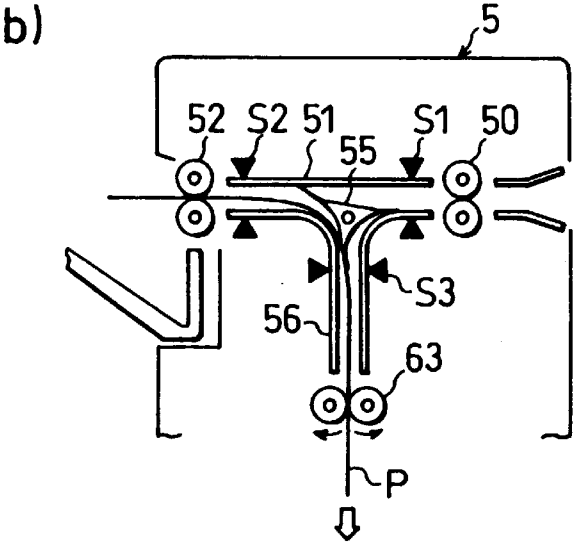
Figure 7C:
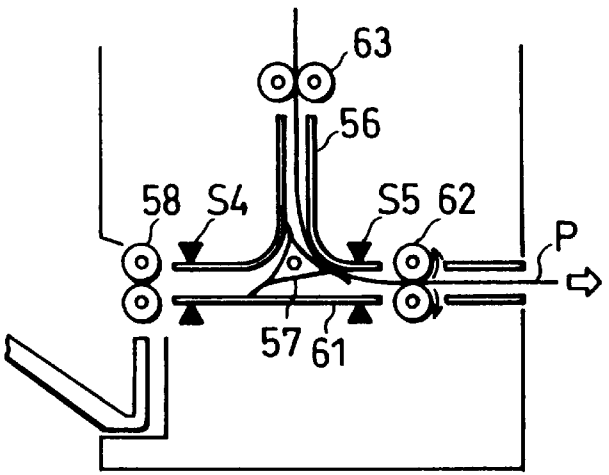
FIG. 7(*a*) is a cross-sectional view showing a state of switching a sheet transport path by the second switching member of the sheet post-processing apparatus, wherein the second switching member is at the first switch position, and the sheet is being transported from the branched transport path to the second discharge tray.
Figure 7D:
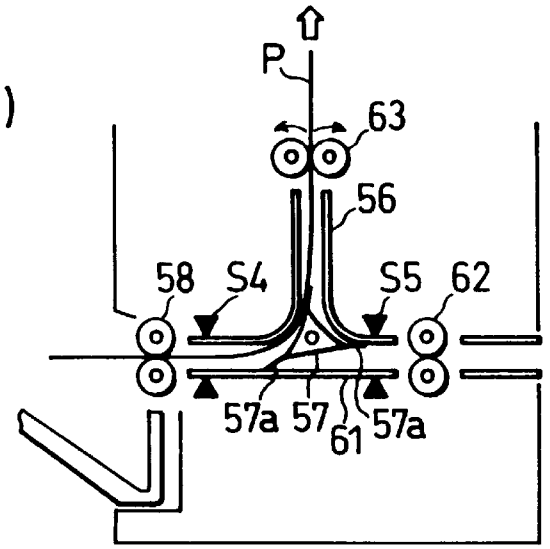
Figure 7A:
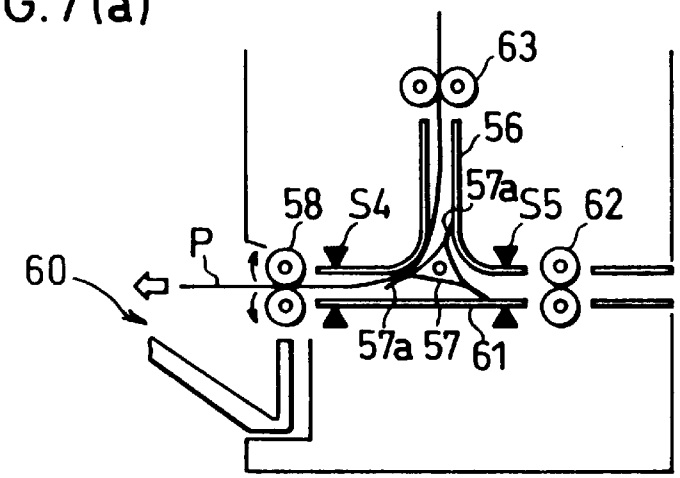
Figure 7B:
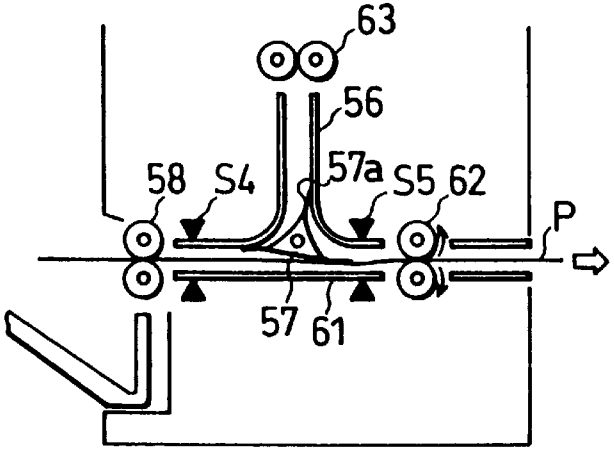

FIG. 5 shows an operation panel formed on the operation panel unit 45 in the copying machine main body 1. At the central portion of the operation panel, a touch panel liquid crystal display device 6 is formed, and a group of various mode setting keys is formed so as to surround it.

On the screen of the touch panel liquid crystal display device 6, a screen switch instruction area for switching a screen for selecting the image editing function is always displayed. Upon directly depressing the area with a finger, a list of image editing functions is displayed on the liquid crystal screen to allow the operator to select image editing functions.

Then, an editing function is selected among various editing functions as desired by touching the area in which the function desired by the operator is displayed.

A group of various setting keys placed on the operation panel will be briefly explained. A brightness adjusting dial 7 for adjusting the brightness of the screen of the liquid crystal display device 6 is provided.

An automatic magnification ratio selecting key 8 is provided for automatically selecting the magnification. A zoom key 9 is provided for enabling the magnification ratio of copying to be set in percentage. Fixed magnification ratio keys 10 and 11 are provided for selecting a fixed magnification ratio. A 100% magnification ratio key 12 is provided for permitting the magnification to be set back to a normal magnification ratio (100%).

A density adjustment key 13 is provided for switching the adjustment of density from the automatic mode to the manual mode or the photograph mode in copying. A density adjustment key 14 is provided for permitting a fine adjustment of a density level in the manual mode or the photographic mode. A cassette (tray) selection key 15 is provided for selecting the sheet size as desired among the sheet size set in the feed section of the copying machine.

A number selecting key 16 is provided for selecting the number of copies to be produced. A clear key 17 is provided for clearing a selected number of copies, or interrupting successive copying operations before being completed. A start key 18 (print switch key) is pressed for instructing the start of copying. A reset key 19 is provided for cancelling all the modes currently set and restoring the normal mode. When successive copying operations are being performed, if a copy of another document needs to be produced, an interruption key 20 is pressed. When the operator does not know how to operate the digital image forming apparatus, an operation guide key 21 is pressed. A message forward key 22 is pressed to change the massage displayed upon pressing the operation guide key 21 while forwarding the displayed message.

A double-sided mode selecting key 23 is pressed to select the double-sided copy mode. A post-processing mode selecting key 24 is pressed to select an operation mode of the post-processing apparatus 5 for sorting copied matter output (a sheet having an image formed thereon) from the copying machine. In the present invention, the post-processing mode selecting key 24 is a selection key for selecting a discharge end of a sheet as desired.

Keys 25 through 27 are printer/fax mode related keys. Specifically, a memory transmission mode key 25 is provided for transmitting a document that is once stored in memory. A copy/fax printer mode switching key 26 is provided for switching a mode of the digital copying machine between the fax mode and the printer mode. A one-touch dial key 27 is provided for starting the transmission of a telephone call to an addressee whose telephone number has been stored in the digital copying machine in advance.

The above-mentioned structure of the control panel, relating to the types and locations of the various keys, is merely an example. Therefore, the structure of the control panel may vary depending on various functions provided for the digital copying machine.

[One Embodiment of Sheet Post-Processing Apparatus]

Referring now to FIG. 1, the following descriptions will explain in detail the sheet post-processing apparatus 5 of the digital image forming apparatus. Here, the sheet post-processing apparatus 5 is provided so as to be detachable from the digital copying machine main body 1.

The sheet post-processing apparatus 5 receives a sheet P (printing material) having an image formed thereon by the digital copying machine main body 1 shown in FIG. 2. Then, the sheet post-processing apparatus 5 transports the sheet P through the discharging transport path formed therein. The sheet P is further transported in a direction set for a selected image forming mode. As a result, the sheet P having an image formed thereon is aligned and stacked in proper page order, thereby completing a printed material aligned in an appropriate state.

As illustrated in FIG. 1, the sheet post-processing apparatus 5 includes a sheet entrance opening 5*a* formed at position corresponding to a position through which the sheet P is discharged by the sheet discharge rollers 4 (see FIG. 2) formed on the side of the digital copying machine main body 1, and feed rollers 50 placed so as to face the sheet entrance opening 5*a*. The feed rollers 50 are provided on an extended transport path along which the fuser 36 and the sheet discharge rollers 4 are provided in the distal copying machine main body 1 at a leading end of the first transport path 51 formed in a straight line.

On the opposite side of the feed rollers 50 formed along the first transport path 51 (first transport path), provided are the first transport rollers 52. The first transport rollers 52 are arranged so as to be capable of rotating in both normal and reverse directions, and permit the sheet P to be transported in a reverse direction when needs arises. Further, the first discharge tray 53 is provided for receiving the sheet P discharged through the first transport path 51.

As described, the sheet P received through the sheet entrance opening 5*a* is sent to the first transport path 51, and then discharged without being reversed onto the first discharge tray 53 through the first transport rollers 52 along the transport direction of the feed rollers 50. The described first transport rollers 52 and the first discharge tray 53 constitute the first sheet discharge section 54.

Further, the first transport path switching member (hereinafter simply referred to as a first switching member) 55 is formed along the first transport path 51 for switching the transport path for the sheet P being transported. Specifically, the transport path for the sheet P is switched as the first switching member 55 is moved at a predetermined timing by drive means such as a solenoid. A branched transport path 56 is provided at position where the transport path is switched by the first switching member 55. This arrangement enables the sheet P being transported along the first transport path 51 to be guided to the branched transport path 56 at the switch position of the first switching member 55.

Within the sheet post-processing apparatus 5, provided is the second transport path 61 (second transport path) farmed in parallel to and symmetrical with the first transport path 51 about the branched transport path 56. The branched transport path 56 is provided so as to connect the second transport path 61 and the first transport path 51 to form a T-shape with respect to the first transport path 51 and the second transport path 61 respectively. Therefore, in order to guide the sheet P from the first transport path 51 to the second transport path 61, the second switching member 57 is provided along the second transport path 61 so as to correspond to the first switching member 55, i.e., at a junction between the branched transport path 56 and the second transport path 61.

Therefore, the sheet P being transported through the first transport path 51 via the branched transport path 56 can be guided to the second transport path 61 according to the switch position of the second switching member 57.

The second transport path 61 is connected to the retransport path 38 (see FIG. 2) formed within the copying machine main body 1. The retransport path 38 which includes an intermediate tray for temporarily storing the sheet P is provided for forming an image again on both sides or one side of the sheet by the digital copying machine main body 1. The second transport path 61 is connected to the retransport path 38 in a straight line.

In a vicinity of an end portion opposite to the portion of the second transport path 61 connected to the retransport path 38, provided are the second transport rollers 58 for transporting the sheet P to the outside of the sheet post-processing apparatus 5, and to the retransport path 38 or to the first discharge tray 53 if needs arise. The second transport rollers 58 are arranged so as to be capable of rotating in both normal direction and reverse direction, and by switching the rotation direction when needs arise, the transport direction of the sheet P can be switched. Furthermore, the second discharge tray 59 is provided for receiving the sheet P sent through the second transport rollers 58. The second transport rollers 58 and the second discharge tray 59 constitute the second sheet discharge section 60.

Discharge rollers 62 are provided at the end portion on the side of the retransport path 38 of the second transport path 61 for carrying the sheet P to the retransport path 38 connected to the second transport path 61. As described, the sheet P guided to the first transport path 51 through the feed rollers 58 are guided to the branched transport path 56 according to the switch position of the first switching members 55. At the switch position of the second switching member 57 on the side of the second transport path 61, the sheet is transported to the second discharge tray 59 through the second transport rollers 58.

Alternately, it may be arranged such that when the sheet P is being transported to the second discharge tray 59 via the second transport rollers 58, the feeding direction by the second transport rollers 58 is reversed upon detecting the rear end of the sheet P in front of the second transport rollers 58 to linearly send back the sheet P to the retransport path 38 including the intermediate tray via the discharge rollers 62. In this state, by carrying out an image forming process again on the sheet P fed into the retransport path 38, an image is formed on the back surface, i.e., the opposite surface to the surface having an image formed thereon by the previous image forming process. Namely, in the described operation, the sheet P is reversed so that the surface having an image formed thereon faces downwards to be fed to the intermediate tray of the copying machine main body 1.

In this case, according to the switch position of the second switching member 57, the sheet P being transported along the first transport path 51 and the branched transport path 56 may be sent to the intermediate tray formed along the retransport path 38 on the side of the copying machine main body 1 via the discharge rollers 62 without being guided to the second transport rollers 58. In this state, when performing an image forming process again on the sheet P, an image is formed on the same surface as the surface on which an image is formed by the previous image forming process. Namely, in the described operation, the sheet is fed on the intermediate tray on the side of the copying machine main body 1 without being reversed.

The third transport rollers 63 are provided along the branched transport path 56 to be connected to the first and second transport paths 51 and 61 through the first and second switching members 55 and 57. The third transport rollers 63 are arranged so as to be capable of rotating both in normal and reverse directions, and transport the sheet P being fed into the branched transport path 56 to the first transport path 51 or the second transport path 61.

In order to control the state of the sheet P being transported along each transport path, a plurality of sensors (sheet detection means) are provided. Specifically, along the first transport path 51, formed are the first sensor S1 for detecting a sheet P being transported to the sheet entry opening 5*a* through the discharge rollers 4 from the copying machine main body 1. The first sensor S1 is formed on the downstream side of the feed roller 50 along the flow of the sheet P being transported in the order of: the sheet entry opening 5*a*→the first transport path 51→the first discharge tray 53. Then, the second sensor S2 for detecting the state where the sheet P is being transported to the first discharge tray 53 by the first transport rollers 52 is formed in front of the first transport rollers 52, i.e., on the upstream side in the transport direction of the sheet P.

On the branched transport path 56, provided is the third sensor S3 for detecting that the sheet P is guided from the first switching member 55 on the downstream side of the first switching member 55 and the upstream side of the third transport rollers 63 along the transportation of the sheet P in the order of: the first transport path 51→the branched transport path 56→the second transport path 61.

Furthermore, on the second transport path 61, provided is the fourth sensor S4 for detecting that the sheet P is being transported to the discharge tray 59 by the second transport rollers 58 in front of the second transport rollers 58, i.e., on the upstream side along the transportation of the sheet P in the order of: the branched transport path 56 the second transport path 61→the second discharge tray 59. Lastly, the fifth sensor S5 for detecting that the sheet P fed to the retransport path 38 of the digital copying machine is provided in front of the discharge rollers 62, i.e., on the upstream side in the sheet transport direction along the transportation of the sheet P in the order of: the branched transport path 56→the second transport path 61→the retransport path 38.

The number of the sensors may be increased or decreased as long as the state of the sheet being transported can be controlled.

Sheet detection signals obtained from the sensors S1 through S5 are sent to the sorter control unit 46 shown in FIG. 4, and the sheet P being transported within the sheet post-processing apparatus 5 is controlled by the sorter control unit 46. The sorter control unit 46 controls a switching of the transport path by respective switching members 55 and 57 within the sheet post-processing apparatus 5, and controls rotary movement of the rollers 52, 58, and 63, etc., in normal and reverse rotations for transporting the sheet P.

FIG. 6(*a*) through FIG. 6(*d*) show switching operation control states of the first switching member 55 for branching the transport path of the sheet P. FIG. 7(*a*) through FIG. 7(*d*) show switching operation control states of the second switching member 57 for branching the transport path of the sheet P on the downstream side of the first switching member 55.

The following will explain the transport state of the sheet P at the switch position of the first and second switching members 55 and 57. To begin with, the transport state of the sheet P by the first switching member 55 will be explained in reference to FIG. 6(*a*) through FIG. 6(*d*).

First, the structure of the first switching member 55 will be explained. The first switching member 55 has a substantially triangular cross section to allow the sheet to be surely guided to the branched transport path 56 from the first transport path 51 or to the first transport path 51 from the branched transport path 56 according to each switch position by the first switching member 55. At an apex, an elastic thin film S5*a* for opening or closing the transport path for the sheet P is formed. The film 55*a* is in contact with, or in a vicinity of one of the guide surface on which the leading end thereof forms the transport path at each switch position, to allow the entry of the sheet in one direction and prohibit the entry of the sheet in the other direction.

As shown in FIG. 6(*a*), in the case where the first switching member 55 is set to the first switch position (first position), the sheet being transported through the first transport path 51 from the entry opening 5*a* is guided to the first sheet discharge section 54. In this case, the first transport rollers 52 are driven in a direction of discharging sheet P, i.e., in a normal direction. On the other hand, the feed rollers 50 are always driven in a direction of transporting the sheet P to the first sheet discharge section 54.

Then, in the state where the first switching member 55 is set in the first switch position, when the rotation direction of the first transport rollers 52 is switched to rotate in a reverse direction upon detecting the rear end of the sheet P by the sensor S2, as shown in FIG. 6(*b*), the transport direction of the sheet P is switched to be transported back from the first discharge section 54 to the branched transport path 56 by the first switching member 55.

Next, as shown in FIG. 6(*c*), when the first switching member 55 is set to the second switch position (second position) different from the positions shown in FIG. 6(*a*) and FIG. 6(*b*), the sheet P fed by the feed rollers 50 through the first transport path 51 is guided to the branched transport path 56. In this case, the third transport rollers 63 are driven to rotate in the direction of transporting the sheet P from the first transport path 51 to the second transport path 61, i.e., in the normal direction.

In the state where the first switching member 55 is set to the second switch position, when the rotation direction of the third transport rollers 63 is switched to rotate in a reverse direction upon detecting the rear end of the sheet P by the sensor S3, as shown in FIG. 6(*d*), the transport direction of the sheet P is switched to be transported back from the branched transport path 56 to the first transport path 51 to be guided to the first sheet discharge section 54.

For example, as shown in FIG. 6(*b*), in the state where the first switching member 55 is set at the first switch position, when the transport direction of the sheet P is switched to a reverse direction upon detecting the rear end of the sheet P being transported by the sensor S3, the transportation through the first transport path 51 to the first sheet discharge section 54 by the first switching member 55 is stopped to guide the sheet P to the feed rollers 50. Therefore, as shown in FIG. 6(*a*) and FIG. 6(*b*), in the state where the first switching member 55 is set to the first switch position, the sheet P being transported to the first transport path 51 through the feed rollers 50 is guided to the first discharge section 54, and while the sheet P being sent to the discharge tray 53, by switching the first transport rollers 52 to rotate in a reverse direction upon detecting the rear end of the sheet P by the sensor S2, the sheet P can be sent to the branched transport path 56.

Next, the transport state of the sheet P by the second switching member 57 will be explained in the similar manner as the first switching member 55 in reference to FIG. 7(*a*) through FIG. 7(*d*). First, in the state where the second switching member 57 is set at the first switch position, i.e., in the position shown in FIG. 7(*a*), the sheet P being transported through the branched transport path 56 is guided to the second sheet discharge section 60. Here, the second transport rollers 58 are driven to rotate in a normal direction, i.e., a direction of transporting the sheet P to the second sheet discharge section 60.

In the state where the second switching member 57 is kept at the first switch position, when the rotation direction of the second transport rollers 58 is switched in a reverse direction to switch the transport direction of the sheet P in a reverse direction upon detecting the rear end of the sheet P in front of the second transport rollers 58 in the transport direction by the sensor S4, as shown in FIG. 7(*b*), the sheet P being transported from the second sheet discharge section 60 is guided to the discharge rollers 62 along the second transport path 61. Here, the discharge rollers 62 are always driven in the direction of feeding the sheet P to the retransport path 38 on the side of the digital copying machine.

Then, as shown in FIG. 7(*c*), when the second switching member 57 is set to the second switch position (second position), the sheet P being transported through the branched transport path 56 is guided to the discharge rollers 62 of the second transport path 61. As shown in FIG. 7(*d*), in the state where the second switching member 57 is set to the second switch position, the rotation direction of the second transport rollers 58 is switched to rotate in a reverse direction upon detecting the rear end of the sheet P by the sensor S4, to guide the sheet P being transported back from the second sheet discharge section 60 to the branched transport path 56 from the second transport path 61.

As to the second switching member 57, in order to enable a switching of the transport path for the sheet P to surely guide the sheet P in an appropriate direction, the second switching member 57 has a cross section of a substantially triangular shape, and a thin film 57*a* made of an elastic polyester film, etc., is formed at each apex. The function of the second switching member 57 is the same as the first switching member 55. Namely, when the second switch member 57 is set at the first switch position, the sheet P being transported to the branched transport path 56 can be guided to the second sheet discharge section 60 of the second transport path, and the sheet P being transported to the second discharge section 60 can be guided to the retransport path 38 of the copying machine main body 1 via the second transport path 61.

As described, in the first switch position, the first switching member 55 guides the sheet P discharged from the copying machine main body 1 directly to the first discharge tray 53 via the first transport path 51, and the sheet P being discharged on the first discharge tray 53 is reversed by the first transport rollers 52 to be guided to the branched transport path 56 by reversing the rotation direction of the first transport rollers 52 when the rear end of the sheet P has passed the first switching member 55. On the other hand, in the second switch position, the sheet P discharged from the copying machine main body 1 is guided to the branched transport path 56, and by reversing a transport direction of the second transport rollers 58, the sheet P is guided to the first discharge tray 53 through the first transport path 51 from the branched transport path 56.

As described, in the case of switching back the sheet P at a junction at which the first switching member 55 is provided, the need of switching the switch position of the first switching member can be eliminated. Furthermore, only by providing one switching member with respect to one branched position, the four ways of transporting the sheet P as shown in FIG. 6(*a*) through FIG. 6(*d*) can be achieved. This effect can be achieved also from the second switching member 57.

[Selection of Sheet Discharge End Corresponding to Image Forming Mode]

With regard to the described sheet post-processing apparatus 5 having the described arrangement, the following will explain the function of selecting the discharge end of the sheet P having an image formed thereon according to an image forming mode such a fax mode, a printer mode, a copy mode, etc., in accordance with the present embodiment.

Figures 8, 9:
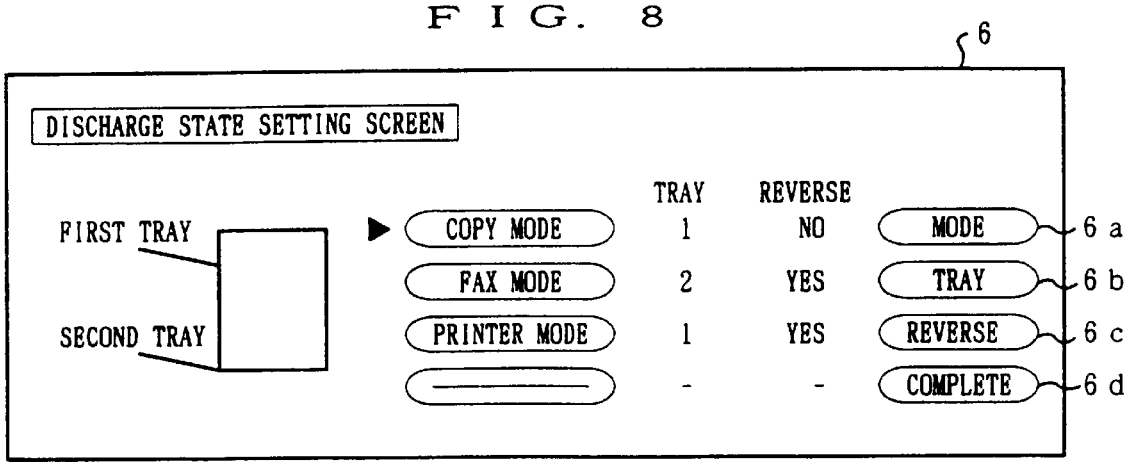
FIG. 8 is a plan view showing the state where a selection screen which allows a discharge tray of a discharge end to be selected as desired is displayed on a display device on an operation panel in the sheet post-processing apparatus of FIG. 1.
FIG. 9 is an explanatory view showing one example of the data table which stores beforehand various discharge states as set in the sheet post-processing apparatus.

FIG. 8 shows a display state for setting the discharge end as desired according to each image forming mode, wherein a display is performed in such a manner that the input of setting is permitted on a touch panel liquid crystal display device 6 formed on an operation panel section. The display is performed as shown in FIG. 8 by operating the post-processing mode setting key 24 on an operation panel explained earlier in reference to FIG. 5.

In the display state shown in FIG. 8, the discharge tray can be selected as desired according to each image forming mode, and the discharge state of the sheet P can be set at the same time. For example, by depressing the mode display section 6*a* (touch panel key) displayed on the display device 6, a mark indicative of a portion corresponding to the copy mode is displayed. Then, by sequentially depressing the mode display section 6*a*, the mark is moved from the fax mode, the printer mode, and the copy mode, and the mode state of marked position is highlighted.

When the copy mode is selected, by operating the tray display section 6*b* indicative of the discharge end, the first discharge tray 53 or the second discharge tray 59 can be selected as a discharge end of the printed sheet as desired. Furthermore, by operating the reverse display section 6*c*, the discharge state of the sheet P, i.e., whether the sheet P is to be discharged after being reversed or without being reversed is selected. Namely, by pressing once the reverse display section 6*c*, the display is switched from the non-reverse state to the reverse state, and upon pressing the portion again, the non-reverse state is displayed again.

As described, upon completing the setting of the discharge end and the discharge state, by operating the complete display section 6*d,* the setting of the discharge end corresponding to the image forming mode and the set state are confirmed as set. Then, the display screen of the display device 6 is switched to the initial display screen.

In the setting state shown in FIG. 8, in the copy mode, the first discharge tray 53 is selected as the discharge end of the sheet P, and the sheet P is discharged onto the first discharge tray 53 with an image forming surface facing upwards (face up state) without reversing the sheet P being discharged from the copying machine main body 1. In the fax mode, the second discharge tray 59 is selected, and the sheet P is discharged after being reversed to have the image forming surface facing downwards (face down state). In the printer mode, the first discharge tray 53 is selected, and the sheet P is discharged after being reversed to have the image forming surface facing downwards (face down state).

As described, the discharge end of the sheet P is selected as desired, and each discharge tray is selected according to the selection of the discharge end. Then, in order to determine the discharge state of the tray, the data table shown in FIG. 9 is stored in the copying machine main body 1 or the sheet post-processing apparatus 5. The data table is stored in the memory in an unerasable manner even after turning OFF the power source. In the described setting, the control operation for a sequential discharge will be explained.

As shown in FIG. 9, the discharge state in which the sheet P is discharged onto the first discharge tray 53 with an image forming surface facing upwards is denoted as a discharge state "A", the discharge state in which the sheet P is discharged onto the second discharge tray 59 after being reversed is denoted as a discharge state "B", the discharge state in which the sheet P is discharged onto the first discharge tray 53 after being reversed is denoted as a discharge state "C", and the discharge state in which the sheet P is discharged onto the second discharge tray 59 with an image forming surface facing upwards is denoted as a discharge state "D". The described discharge states are stored based on the data table shown in FIG. 8, and a control operation for a discharging process will be explained in reference to FIG. 9.

Here, some copying machines are arranged such that upon receiving all the image data sent from the external device, a hard copy is output according to the image data. In this case, the digital copying machine has an image data memory section of a large memory capacity. In this digital copying machine, a described discharge state is denoted as "D" to manage the described state. In the digital copying machine having the described memory section stored therein, the image can be sequentially output from the image data of the last page being transferred. In the described case, the discharge state is set to "D"; however, if the memory of a sufficient capacity does not exist, and the image data being transferred is output as a hard copy, and the described discharge state "B" or "C" is set as desired.

Figure 10:
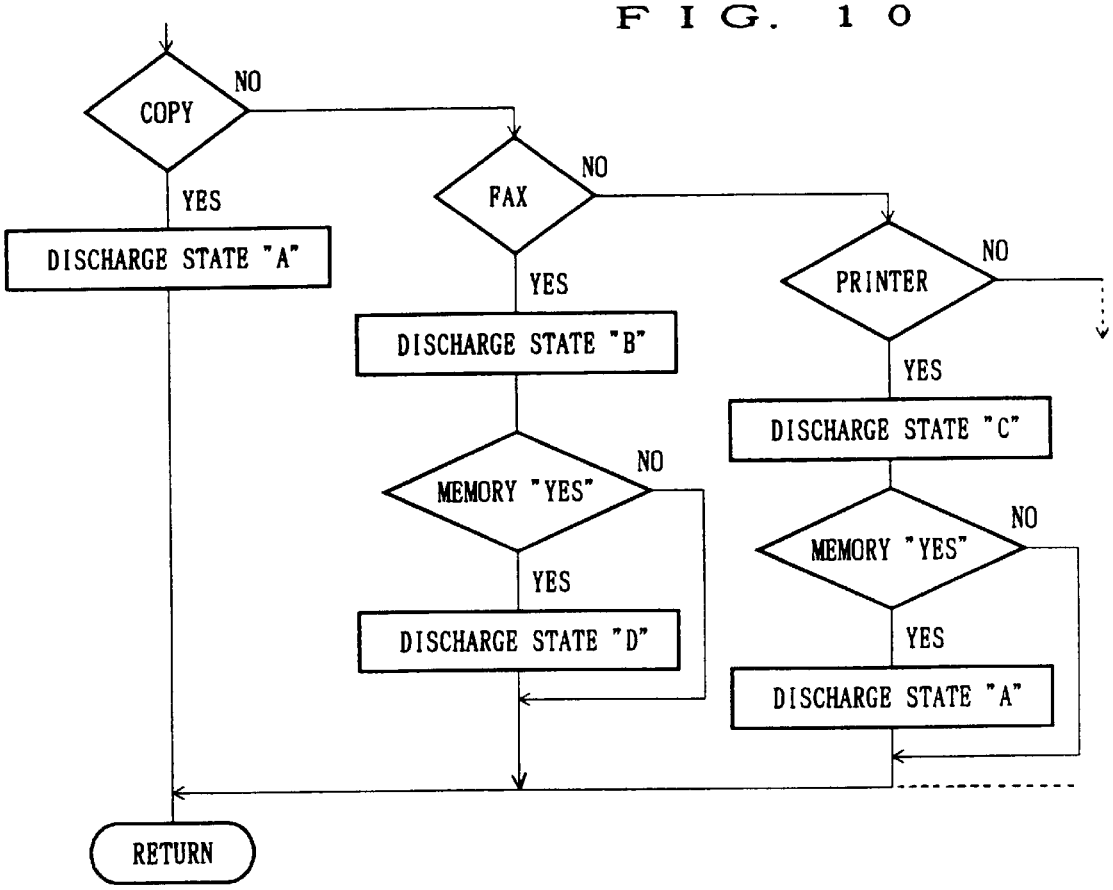
FIG. 10 is a flowchart showing the control process for setting a sheet discharge state according to each image forming mode based on the data table.

Upon starting the image forming process, the process shown in the flowchart of FIG. 10 is executed, and the discharge state of the sheet P corresponding to the image forming mode set as desired in FIG. 8 is confirmed. Therefore, referring to the data table shown in FIG. 9, and any one of the discharge states A through D is confirmed to be set, and a discharge output control is executed in accordance with an image forming process.

Here, if the copy mode is selected as an image forming mode, it is confirmed that the discharge state "A" is selected according to the described data table shown in FIG. 9. On the other hand, if the fax mode is selected as an image forming mode, it is confirmed that the discharge state "B" is selected. However, if the copying machine main body 1 has a memory section (memory) of a sufficient memory capacity for temporarily storing all the image data, the discharge state "B" is not selected but the discharge state "D" is selected. In the fax mode, after setting the discharge state "B", it is confirmed if there exists a sufficient memory capacity in the copying machine main body 1. If not, the discharge state "B" is selected. On the other hand, if it is confirmed that there exists a sufficient memory capacity in the copying machine main body 1 for outputting the image data from the last page, the discharge state is changed to the discharge state "D" and is confirmed.

Further, in the printer mode, the discharge state "C" is selected. However, in the same manner as in the fax mode, if it is confirmed that there exists a sufficient memory capacity in the copying machine main body 1, the discharge state is changed and confirmed that the discharge state "C" is selected. On the other hand, if it is not confirmed that there exists sufficient memory capacity, it is confirmed that the above-explained discharge mode "A" is selected, and the below-described sheet discharge processing control will be executed.

[Copy Mode: Discharge State "A"]

Figure 11:
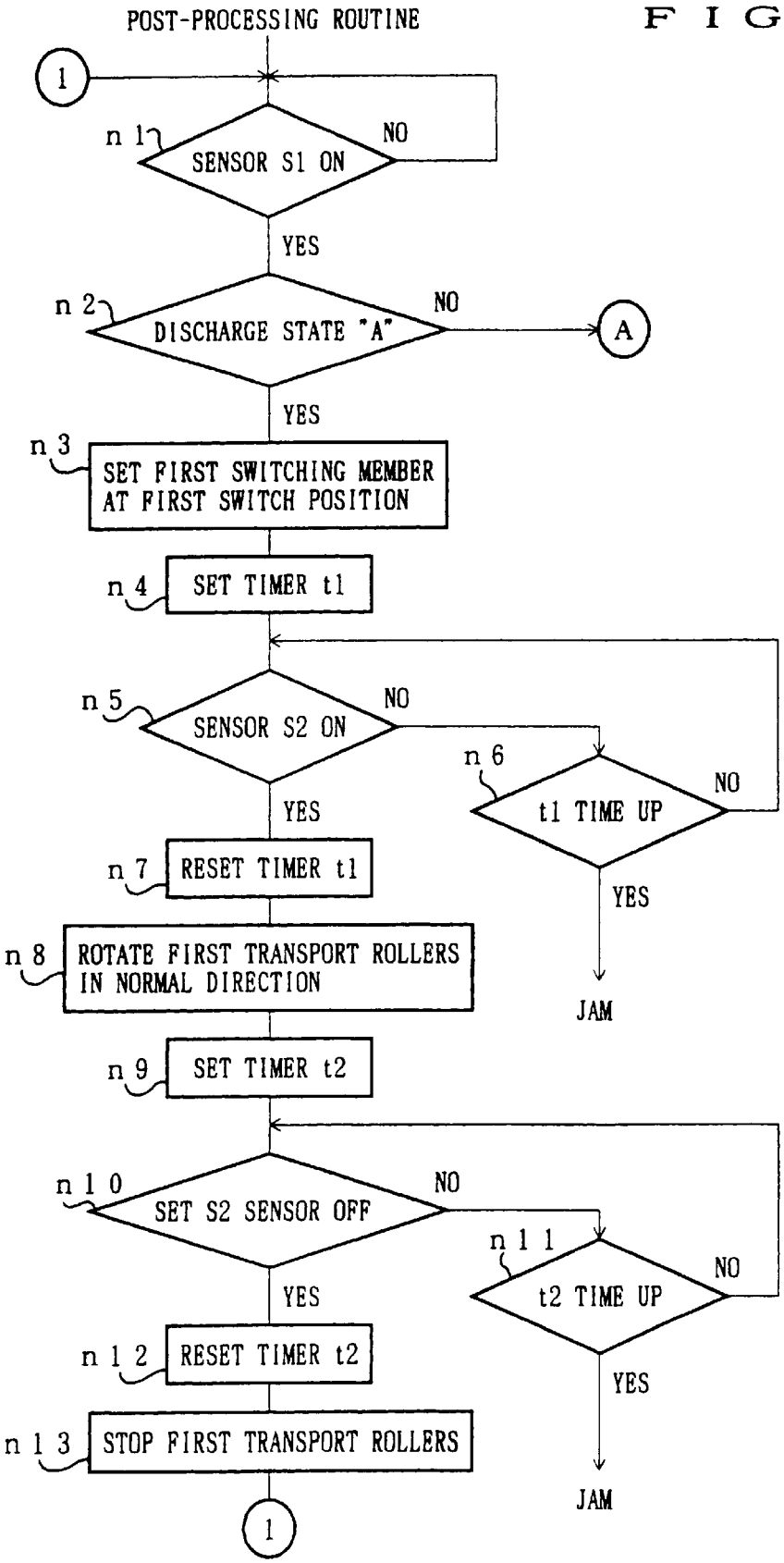
FIG. 11 which shows a process of controlling a discharging process in the sheet post-processing apparatus of FIG. 1 is a flowchart showing a process of discharging a sheet particularly in a discharge state corresponding to a copy mode of the digital copying machine.

FIG. 11 is a flowchart showing processes of controlling a discharge process from the sheet post-processing apparatus 5 in which a sheet P having an image formed thereon is discharged by the copying machine main body 1. As explained in reference to FIG. 10, the described processes are carried out by the sheet post-processing apparatus 5 when the discharge state "A" is selected. Here, the copying machine main body 1 is set to a one-sided copy mode in which an image is formed on one side of the sheet P. In this processes, the first sheet discharge section 54 is used for aligning the sheet P in proper page order.

The sheet P being fed via the discharge rollers 4 through a sheet discharge opening of the copying machine main body 1 at predetermined intervals is sequentially fed to the post-processing apparatus 5. Then, the sheet P is received through the sheet entrance opening 5*a* of the post-processing apparatus 5. When the sheet P is taken in by the feed rollers 50, upon detecting the leading end portion of the sheet P by the first sensor S1 (n1), it is confirmed if the discharge state "A" corresponding to the copy mode is selected (n2). If it is confirmed that the discharge state "A" is selected, the first switching member 55 is set to the first switch position (the state of FIG. 6(*a*)) (n3). Then, the timer t1 for controlling the state of the sheet P being transported is set (n4). Further, based on the detection of the leading end portion of the sheet P by the sensor S2 within a predetermined time set by the timer t1, it is determined if the sheet P is surely guided to the first transport roller 52 via the first switching member 55 (n5→n6→n5).

If the sensor S2 does not detect the leading end portion of the sheet P within a time set by the timer t1, i.e., if it is not the ON state, it is determined that an abnormality in transporting the sheet P has occurred, and the sequence goes to the routine for processing the jammed sheet. This jammed sheet processing routine is the same as the normal processing of the jammed sheet during operation, and thus detailed descriptions shall be omitted here. In response to the detection of the jammed sheet, the transportation of the sheet post-processing apparatus 5 is stopped, and the image forming operation in the copying machine main body 1 is temporarily stopped.

On the other hand, if the sensor S2 detects the leading end portion of the sheet P being transported within a predetermined time set by the timer t1, the timer t1 is temporarily reset (n7). Then, the first transport rollers 52 are kept rotating (n8) in order to discharge the sheet P to the first discharge tray 53.

Then, a new timer t2 is set (n9) to control an operation until the sensor S2 detects the rear end portion of the sheet P (OFF state), i.e., the sheet P is discharged onto the first discharge tray 53 (n10→n11→n10). Under the control of the transport state of the sheet P, if the sensor S2 does not detect the rear end portion of the sheet P within a predetermined time set by the timer t2, it is determined that an abnormality in transporting the sheet P has occurred, and the sequence goes to the routine for processing the jammed sheet.

If it is confirmed based on the detection signal (OFF state) by the sensor S2 that the sheet P is surely discharged onto the first discharge tray 53 from the first transport rollers 52, the timer t2 is reset (n12) , and the first transport rollers 52 is stopped at a predetermined timing (at a time the rear end portion of the sheet P is released from the rollers 52) (n13). In the step n13, it may be arranged such that the first transport rollers 52 are kept rotating in the direction of feeding the sheet P to the first discharge tray 53.

Especially, in the case where the copying machine main body 1 is operated in the single-sided copy mode, the feed rollers 50 and the first transport rollers 52 are rotated in a normal direction. It is arranged so to allow the first discharge tray 53 to be selected as a discharge section of the sheet P.

In the copy mode, the described operation is repetitively performed on the sheet P having an image formed thereon discharged from the copying machine main body 1, to carry out a discharge control. As a result, the sheet P is discharged in order with an image forming surface facing upwards to be stacked on the first discharge tray 53.

In the discharge state "A" corresponding to the described copy mode, an image forming operation is carried out in the order of the document stacked on, for example, a document tray of the RADF 2*b*, etc., and thus after having gone through the image forming process, the sheet P is aligned in the order of the document. Especially, the document image is read by the scanner section in order from the last page, and an image is formed in the order of the image as read. Thus, by discharging the sheet P with an image forming surface facing upwards, the sheet P can be surely stacked without being scattered.

In the described operation, the first discharge section 54 is used as the discharge section of the sheet P. However, needless to mention, the same discharge operation may be achieved by using the second discharge section 60 as the discharge section of the sheet P. Here, by setting the first switching member 55 to the second switch position (FIG. 6(*c*)), the transportation of the sheet P can be switched from the first transport path 51 to be fed to the second discharge tray 59 via the branched transport path 56 and the second transport path 61. In this case, the first transport rollers 52 are stopped, and the second transport rollers 58 are driven in a normal direction, and the second switching member 57 is set to the first switch position (the state shown in FIG. 7(*a*)).

[Fax Mode: Discharge State "B"]

The following will explain the processes of controlling a discharge of the sheet P when the digital copying machine is set to the fax mode. If the fax mode is selected as an image forming mode, as shown in FIG. 10, it is confirmed that the discharge state "B" is selected provided that the digital copying machine does not have a memory of a large capacity, and an image is formed in the sending order of the image data. In this case, first, the controlling processes shown in the flowchart of FIG. 11 are executed.

Upon confirming the discharge state "B", the first switching member 55 is maintained at the first switch position, and the second switching member 57 is maintained also at the first switch position. In the meantime, the first transport rollers 52 and the second transport rollers 58 are driven to rotate in a normal direction.

In the case where the digital copying machine performs an image forming operation in the fax mode, the image starts being output according to the receiving order of the image data. Then, the sheet P having an image formed thereon is sent at a predetermined interval to the sheet post-processing apparatus 5 in order through the discharge rollers 4 formed at the sheet discharge opening of the copying machine main body 1. The sheet post-processing apparatus 5 receives the sheet P through the entry opening 5*a* to be further fed inside by the feed rollers 50.

First, as shown in FIG. 11, the first sensor S1 detects the leading end portion of the sheet P in n1. In response to the detection, it is determined if the discharge state "A" is selected in the digital copying machine in n2. In the case where the fax mode is selected for the image forming mode in the digital copying machine, as the discharge state "B" is to be set, the sequence goes from n2 of FIG. 11 to the processes shown in flowchart of FIG. 12.

Figure 12:
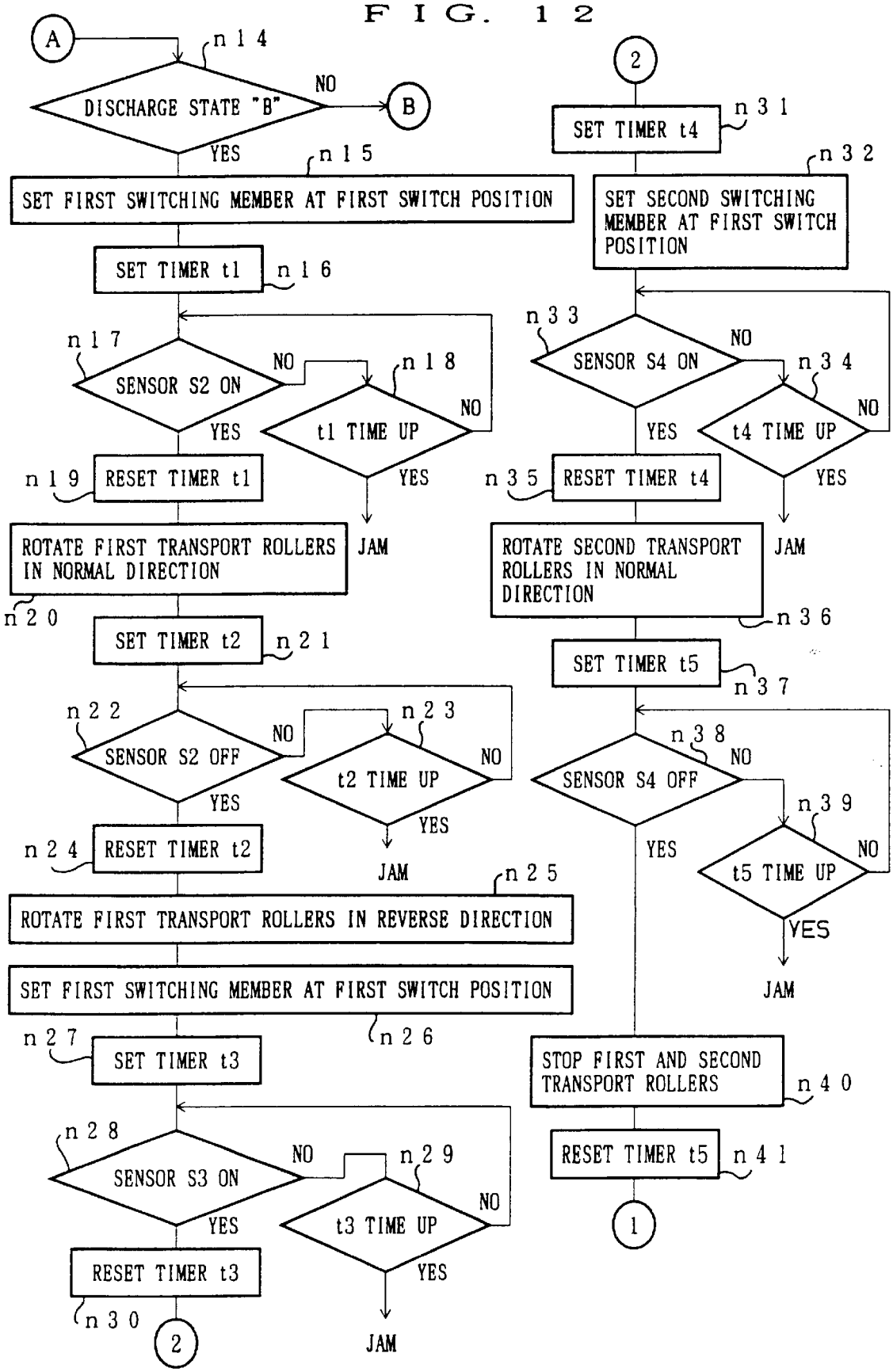
FIG. 12 which shows a process of controlling a discharging process in the sheet post-processing apparatus is a flowchart showing a process of discharging a sheet particularly in a discharge state corresponding to a fax mode of the digital copying machine.

In the flowchart shown in FIG. 12, first it is confirmed in n14 if the discharge state "B" is selected. Upon confirming that the discharge state "B" is selected, the sequence goes to n15, and the following processing routine is executed. Namely, in n15, the first switching member 55 of the switching members is set to the first switch position. In fact, the first switching member 55 and the second switching member 57 are switched to the first switch position beforehand as described earlier, assumed here that they are switched in n15 for convenience in explanations.

Then, a timer t1 for controlling the state of the sheet P being transported is set (n16), and upon detecting the leading end portion of the sheet P by the sensor S2 within a predetermined time set by the timer t1, it can be determined if the sheet P is surely guided to the first transport rollers 52 through the first switching member 55 (n17→n18→n17). The processes described in n15 through n18 are the same as the processes in n3 through n6 in FIG. 11.

However, if the leading end portion of the sheet P cannot be detected by the sensor S2 within the time set by the timer t1, it is determined that an abnormality in transporting the sheet P has occurred, and the sequence goes to the routine for processing the jammed sheet.

When the sensor S2 detects the leading end portion of the sheet P within the time set in the timer t1, the timer t1 is once reset (n19). Then, the first transport rollers 52 are kept rotating in a normal direction for transporting the sheet P to the discharge tray 53 (n20). Here, it may be also arranged such that the first transport rollers 52 start rotating upon detecting the leading end of the sheet P by the sensor S2, or the first transport rollers 52 start rotating at a timing the sensor S1 detects the entry of the sheet P. The timing the first transport rollers 52 start driving may be set as desired.

Next, a new timer t2 is set in n21. The timer t2 controls the state of the sheet P being transported towards the first discharge tray 53 based on a timing the sensor S2 detects the rear end portion of the sheet P (n22→n23→n22). Like the control process of the sheet P being transported by the sensor S1, if the sensor S2 does not detect the rear end portion of the sheet P after a predetermined time has elapsed, it is determined that an abnormality in transporting the sheet P has occurred, and the sequence goes to the routine of processing a jammed sheet.

When the sensor S2 detects the rear end portion of the sheet P (OFF state), the timer t2 is reset (n24). The described routine is the same as the processing routine shown in FIG. 11, and the processes in and after n25 are different from those shown in the processing routine in FIG. 11. In n25, the sensor S2 detects the rear end portion of the sheet P, and in the meantime, the rotation direction of the first transport rollers 52 is switched from the normal rotation to the reverse rotation. In this state, the first switching member 55 is held at the first switch position (S26). The sheet P sandwiched between the first transport rollers 52 is transported to be switched back by the reverse rotations of the first transport rollers 52, to be guided from the first transport path 51 to the branched transport path 56 via the first switching member 55.

Here, a new timer t3 is set (n27), and the state of the sheet P being transported in a vicinity of the first switching member 55 to be guided to the branched transport path 56 is controlled based on the detection signal of the sheet P from the sensor S3 (n28→n29→n28). However, if the leading end portion of the sheet P is not detected by the sensor S3 within the time set by the timer t3, it is determined that an abnormality in transporting the sheet P has occurred, and the sequence goes to the routine of processing a jammed sheet.

When the sensor S3 detects the sheet P being guided to the branched transport path 56 by the first switching member 55 (ON), the timer t3 is once reset (n30), and a new timer t4 is set (n31). In the meantime, the second switching member 57 is set to the first switch position (the state shown in FIG. 7(*a*)) (n32). In fact, the described setting operation is performed upon stating an image forming operation by the digital copying machine in the fax mode; however, for convenience in explanations, assumed here that such operation be performed in n32.

In the state where the second switching member 57 is set to the first switch position, the sheet P being transported in the branched transport path 56 is guided to the second discharge section 60, i.e., to the second discharge tray 59 through the second transport rollers 58 via the second transport path 61.

Furthermore, when the sensor S4 detects the leading end portion of the sheet P being guided by the second switching member 57 (ON) (n33), the second transport rollers 58 are maintained to rotate in a normal direction (n36).

However, prior to the described operation, the timer t4 controls the transport state of the sheet P in a vicinity of the second switching member 57 (n33→n34→n33). Namely, if the sheet P is not detected by the sensor S4 within the time set by the timer t4, it is determined that an abnormality in transporting the sheet P has occurred, and a sequence goes to the routine of processing a jammed sheet.

If the abnormality in transporting the sheet P is not detected, the timer t4 is reset (n35), and the second transport rollers 58 are kept rotating (n36). Then, the timer t5 is set (n37). By setting the timer t5, an operation of controlling the state of the sheet P being properly transported to the second discharge tray 59 by the second transport rollers 58 is performed (n38→n39→n38).

If an abnormality in transporting the sheet P is detected, the sequence goes to the routine of processing a jammed sheet. On the other hand, if it is confirmed that the sheet P is being transported properly, according to the timing the sheet P is discharged from the second transport rollers 58 to the second discharge tray 59, the first and second transport rollers 52 and 58 are stopped driving (n40). Namely, the sensor S4 detects the rear end portion of the sheet P in n38 (OFF state), and the first and second transport rollers 52 and 58 are stopped driving (n40), and the timer t5 for controlling the sheet P being discharged from the second transport rollers 58 to the second discharge tray 59 is reset (n41). Here, in order to feed the next sheet P by the second transport rollers 58, it may be arranged so as to maintain the rotation of the second transport rollers 58. Especially, it is preferable that the first transport rollers 52 be driven according to a timing the sensor S1 detects the sheet P fed through the feed rollers 50.

In the fax mode, a sheet discharging operation is controlled by sequentially performing the described operation under the same control with respect to the sheet P having an image formed thereon, that is sequentially discharged from the copying machine main body 1. In this case, the sheet P is sequentially discharged onto the second discharge tray 59 with the image forming surface facing downwards. Therefore, the image being sent by the fax is aligned in proper page order for sure.

Namely, in the fax mode, the image is normally sent in order from the first page. Therefore, in order to align the sheets in proper page order, the sheets are reversed to be discharged onto the second discharge tray 59 by utilizing the first discharge section 54. Therefore, the need of separately providing a switch back transport path can be eliminated, and the first discharge section 54 that is an essential member for discharging the sheets functions also as a switch back transport path, thereby permitting the simplified structure and the miniaturization of the apparatus.

In the described control process for a discharge operation, the first discharge section 54 is used as the switch back transport means, and thus the third transport rollers 63 provided on the branched transport path 56 are not necessarily required. Namely, as long as the branched transport path 56 is provided, it is only required to design the first transport rollers 52 and the transport rollers 58 to have a length required for processing a minimum size sheet. This permits further reduction in size of the apparatus. Additionally, in replace of the first discharge section 54, the second discharge section 60 may be used as the switch back transport means.

The second transport rollers 58 are always driven in a normal direction, and transport the sheet P to be discharged onto the second discharge tray 59 after being reversed. Moreover, the first switching member 55 has the same position as in the discharge processing state in the described single sided copy mode, and it is not required to perform a switching control, and a discharge process of the sheets can be performed for sure.

The above explanations refer to the case where a sufficient memory capacity does not exist in the digital copying machine 1, and an image is formed on sheets in the sending order of image data from an external unit (for example, by facsimile) to be output. On the side of the digital copying machine which performs an image forming operation on the transferred image data from the last page, it is not required to discharge the sheet P onto the tray after being reversed. For this reason, as described in FIG. 10, the sheet P is discharged in the discharge state "D" to the second discharge tray 59 without being reversed.

In the discharge state "D", the processing control is performed to switch the first switching member 55 to the second switch position (the state shown in FIG. 6(*c*)), and switch the second switching member 57 to the first switch position (see FIG. 7(*a*)). By positively rotating the third transport rollers 63 and the second transport rollers 58 in the normal direction, the sheet P being sent from the digital copying machine main body 1 is stacked in proper page order onto the second discharge tray 59 with an image forming surface facing upwards.

[Printer Mode: Discharge State "C"]

The control process for a discharging operation of the sheet P will be explained in the case where the copying machine main body 1 is set to the printer mode, in which the image data being set from a word processor, a personal computer, etc., is output. In this case, as explained in FIG. 9, the discharge state "C" is selected and confirmed in accordance with the flowchart shown in FIG. 10. In the discharge state "C", the discharge tray which receives sheets having an image formed thereon is set as the first discharge tray 53, and the sheet P is reversed and discharged onto the tray 53.

However, the discharge state "C" is selected for discharging sheets in the copying machine main body 1 when the copying machine main body 1 does not have a large memory capacity, while the discharge state "A" is selected as shown in FIG. 10 when the copying machine main body 1 has a large memory capacity. Then, the control operation for a discharging process in and after the processes shown FIG. 11 will be explained.

When the digital copying machine is set in the discharge state "C", upon starting an output of an image in a printer mode, the sheet P is discharged sequentially at predetermined intervals through the discharge rollers 4 from a discharge opening of the copying machine main body 1. The sheet post-processing apparatus 5 receives the sheet P being discharged in order through the sheet entrance opening 5*a* via the feed rollers 50. As shown in FIG. 11, the sensor S1 detects the leading end portion of the sheet P (n1). Upon detecting the leading end portion of the sheet P, it is confirmed if the discharge state "A" is set in the digital copying machine (n2). In this case, as the discharge state "C" corresponding to the printer mode is selected, the process in n14 shown in the flowchart of FIG. 12 is executed, followed by the control operation shown in FIG. 13.

Namely, when it is confirmed that the discharge state "A" is not selected in n2, it is confirmed in n14 in the flowchart of FIG. 12 if the discharge state "B" is selected. In this case, as the discharge state "B" is not selected, the sequence goes to n42 shown in FIG. 13 to confirm if the discharge state "C" corresponding to the printer mode is selected.

If it is confirmed that the discharge state "C" is selected, the sheet post-processing apparatus 5 sets the first switching member 55 to the second switch position (the state shown in FIG. 6(*c*)) (n43). Then, a timer t6 for controlling the state of the sheet P being transported is set (n44). Then, in order to detect the state of the sheet P being transported to the branched transport path 56, the sensor S3 controls if the sheet P is guided to the branched transport path 56 via the first switching member 55 based on the time counted till the sensor S3 detects the leading end portion of the sheet P (n45→n46→n45).

Therefore, the sheet P being sent to the sheet post-processing apparatus 5 is guided to the branched transport path 56 by the first switching member 55. While the sheet P is being transported to the branched transport path 56, if the sensor S3 does not detect the leading end portion of the sheet P within the period set by the timer t6, i.e., if it is not the ON state, it is determined that an abnormality in transporting the sheet P has occurred, and the sequence goes to the routine for processing the jammed sheet.

Upon detecting the leading end portion of the sheet P by the sensor S3 (ON), the timer t6 is once reset (n47). Then, in order to carry the sheet P to the discharge tray 59 of the second discharge section 60, the second switching member 57 is set to the first switch position (the state shown in FIG. 7(*a*)) (n48), and a new timer t4 is set (n49). Upon detecting the leading end portion of the sheet P by the sensor S4 (ON state) within the time set by the timer t4, the second transport rollers 58 are kept rotating in a normal direction (n53), and the timer t4 is reset (n52). In this case, within the time set by the timer t4, if the sensor S4 does not detect the leading end portion of the sheet P, it is determined that an abnormality in transporting the sheet P has occurred, and the sequence goes to the routine for processing the jammed sheet. Namely, following the steps in n50→n51→n50, the transport state of the sheet P through the branched transport path 56 and the second transport path 61 to the second discharge section 60 is controlled.

Upon detecting that the transport state of the sheet P is normal, the timer t5 is set (n54). Thereafter, if the sensor S4 detects the rear end portion of the sheet P within the time set by the timer t5 (OFF state), the timer t5 is reset (n57), and the rotating direction of the second transport rollers 58 is switched from the normal direction to the reverse direction (n58). Until the rear end portion of the sheet P is detected by the sensor S4 (OFF state), the state of the sheet P being transported is controlled in the processes of n55→n56→n55. If the sensor S4 does not detect the rear end portion of the sheet P within the time set by the timer t5, it is determined that an abnormality in transporting the sheet P has occurred, and the sequence goes to the routine for processing the jammed sheet.

On the other hand, if an abnormality is not detected in the processes of managing the jammed sheet, as described, the second transport rollers 58 are driven in a reverse direction in response to the detection of the rear end portion of the sheet P by the sensor S4. Here, the second switching member 57 is switched from the first switch position (the position shown in FIG. 7(*a*)) to the second switch position (the states shown in FIG. 7(*c*) and 7(*d*), especially the state shown in FIG. 7(*d*)) (n59). Then, the sheet P is turned over to be transported backwards in a reverse direction along the branched transport path 56 to be guided to the first switching member 55 by the second switching member 57. Here, in order to control the state of the sheet P being transported backwards along the branched transport path 56, a timer t7 is set (n60).

If the sensor S3 detects the leading end portion of the sheet P guided to the first switching member 55 by the second switching member 57 along the branched transport path 56 within the time set by the timer t7 (ON state), the timer t7 is reset (n63). In the meantime, the first switching member 55 is set to the second switch position (the states shown in FIG. 6(*c*) and FIG. 6(*d*), especially the state shown in FIG. 6(*d*)) (n64). Namely, the first switching member 55 is maintained at the original position.

As a result, the sheet P is guided to the first discharge section 54 by the first switching member 55. The above explanations have been given through the case where the first switching member 55 is switched when the sensor S3 detects the leading end of the sheet P being transported backwards along the branched transport path 56 (ON state) for simplification. However, such switching may be performed any time during the period from the detection of the rear end portion of the sheet P by the sensor S3 (OFF) while the sheet P is being transported in the normal direction through the branched transport path 56 till the detection of the leading end portion by the sensor S3 (ON state) in the backward transportation of the sheet P. In fact, the first switching member 55 is maintained in the second switch position in the step shown in n43, the switching is not performed in n64.

Additionally, during the period till the sheet P being transported backwards is detected by the sensor S3 (ON state), the state of the sheet P being transported is controlled by the processes in n61→n62→n61. If the sensor S3 does not detect the leading end of the sheet P within the time set by the timer t7 (ON), the sequence goes to the routine for processing the jammed sheet.

When the timer t7 is reset in n63, and state of the sheet P being transported is controlled, and if the sensor S3 does not detect (ON state) the leading end of the sheet P within the period set by the timer t7, the sequence goes to the routine for processing the jammed sheet. In order to control the discharged state, the timer t8 is set (n65), and the detected state by the sensor S2 for detecting the leading end of the sheet P being transported by the first transport rollers 52 is confirmed (n66). The state of the sheet P being transported until the sensor S2 detects the sheet P being transported via the first switching member 55 is controlled by the sensor S2 and the time set by the timer t8 (n66→n67→n66).

Under the described control, if it is determined that the transportation is normal, the timer t8 is reset (n68), and the timer t2 is set (n69). The sensor S2 detects the rear end of the sheet P being transported backwards (OFF), and confirms such detection with the timer t2. By performing the processes in n70→n71→n70, the transportation of the sheet P to be discharged to the first tray 53 is controlled, and if the sensor S2 does not detects the rear end of the sheet P within the time set by the timer t2, the sequence goes to the routine for processing the jammed sheet.

Then, when the sensor S2 detects the sheet P being discharged to the first discharge tray 53 (OFF), the timer t2 is reset (n72), and the rotation of the first transport rollers 52 is stopped. Upon stopping the rotation of the first transport rollers 52 (n73), the reverse rotation of the second transport rollers 58 is stopped simultaneously. As the rotating direction of the first transport rollers 52 is not changed, for example, at the timing of detecting the leading end portion of the sheet P by the sensor S1, the first transport rollers 52 rotate, and are kept rotating in a normal direction until all the sheet P has been transported to the sheet post-processing apparatus 5.

As described, the sheet P having an image formed thereon is sent to the sheet post-processing apparatus 5 with an image forming surface facing upwards; however, a switch back transportation is performed to reverse the transport direction of the sheet P utilizing the discharge processing section to the second discharge tray 59 to be discharged onto the first discharge tray 53. Therefore, the image forming surface faces downwards, and the sheets are sequentially discharged onto the first discharge tray 53. Therefore, even in the printer mode, as the sheet P can be sequentially discharged onto the first discharge tray 53 with an image forming surface facing downwards, the sheet P can be aligned in proper page order of the image data being sent from the external device. Moreover, when performing a switch back transportation, as the transport path to one discharge tray can be utilized, it is not required to specifically provide the switch back transport path, the significant simplification of the structure can be achieved.

In the case where the sheet P is discharged onto the first discharge tray 53 after being reversed, as in the case of reversing the sheet onto the second discharge tray 59 after being reversed, by setting the distance between the first transport rollers 52 and the second transport rollers 58 to the length of the minimum size sheet, the need of the third transport rollers 63 can be eliminated, and a significant reduction in size of the apparatus can be achieved.

As described, by arranging such that the sheet P can be discharged onto a discharge tray selected for each image forming mode such as a fax mode, a printer mode, etc., as the discharging end of the sheet P can be set as desired, the sheet P classified to be discharged on each discharge tray can be removed by the operator with ease.

Here, in the case where the sheet P is reversed by utilizing the second transport rollers 58 to be discharged onto the first discharge tray 53, the rear end of the sheet P being guided to the second transport path 61 is detected by the sensor S4, and the sheet P is reversed at this detection timing. However, in this case, it is required to have a long interval between the sheet P being transported and the next sheet P. Here, it is even more effective to arrange so as to reverse the transport direction of the sheet P upon detecting the rear end of the sheet P being transported to the branched transport path 56, i.e., before the sheet P has been fed into the second transport path 61.

Namely, in the branched transport path 56, as the sensor S3 for detecting the rear end portion of the sheet P at the timing the sheet P passes through the first switching member 55 is provided, by driving the second transport rollers 58 in a reverse direction in response to the detection of the rear end of the sheet P being sent to the branched transport path 56 by the sensor S3, the sheet P can be fed to the first sheet discharge section 54 of the first transport path 51 via the first switching member 55. Therefore, the time required for transporting the sheet P from the sensor S3 to the sensor S4 can be eliminated, and the sheet P can be discharged in a reversed state, thereby permitting a high speed process by transporting the sheet P at a shorter interval.

For another arrangement of discharging the sheet onto the first discharge tray 53 after being reversed, it may be arranged so as to reverse the transport direction by the switch back at the position of the branched transport path 56, and the reverse transport path and the time required for the switch back are can be reduced. The described effect can be achieved with ease by utilizing the timing of detecting the rear end of the sheet P by the sensor S3 as described earlier.

Furthermore, embodiments which perform the operations with improved accuracy will be explained.

Specifically, along the branched transport path 56, the third transport rollers 63 are provided so as to be capable of rotating both in normal direction and reverse direction. Utilizing this third transport rollers 63, a switch back transport control is performed.

Figure 13:
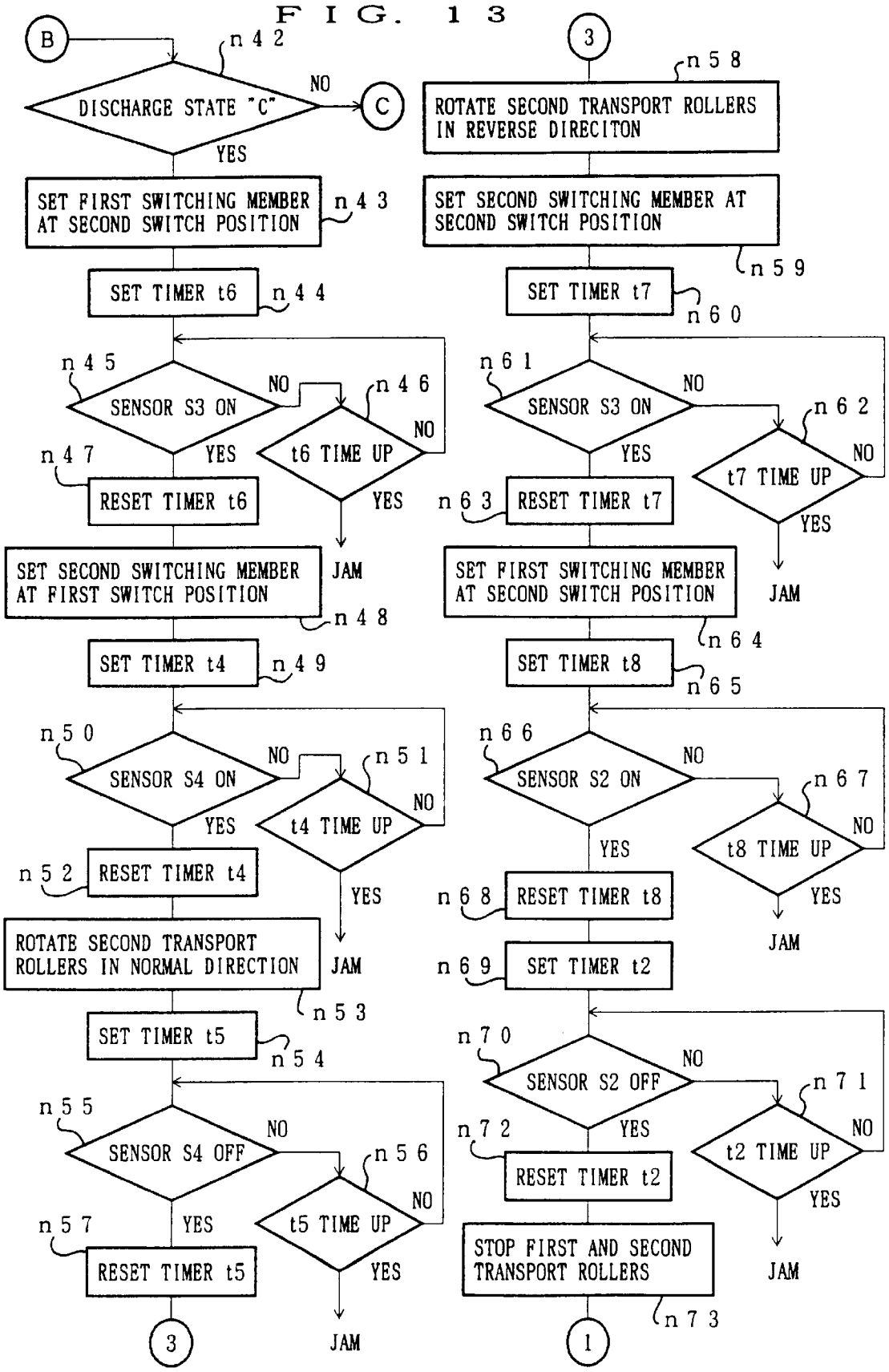
FIG. 13 which shows a process of controlling a discharging process in the sheet post-processing apparatus is a flowchart showing a process of discharging a sheet particularly in a discharge state corresponding to a printer mode of the digital copying machine.
Figure 14:
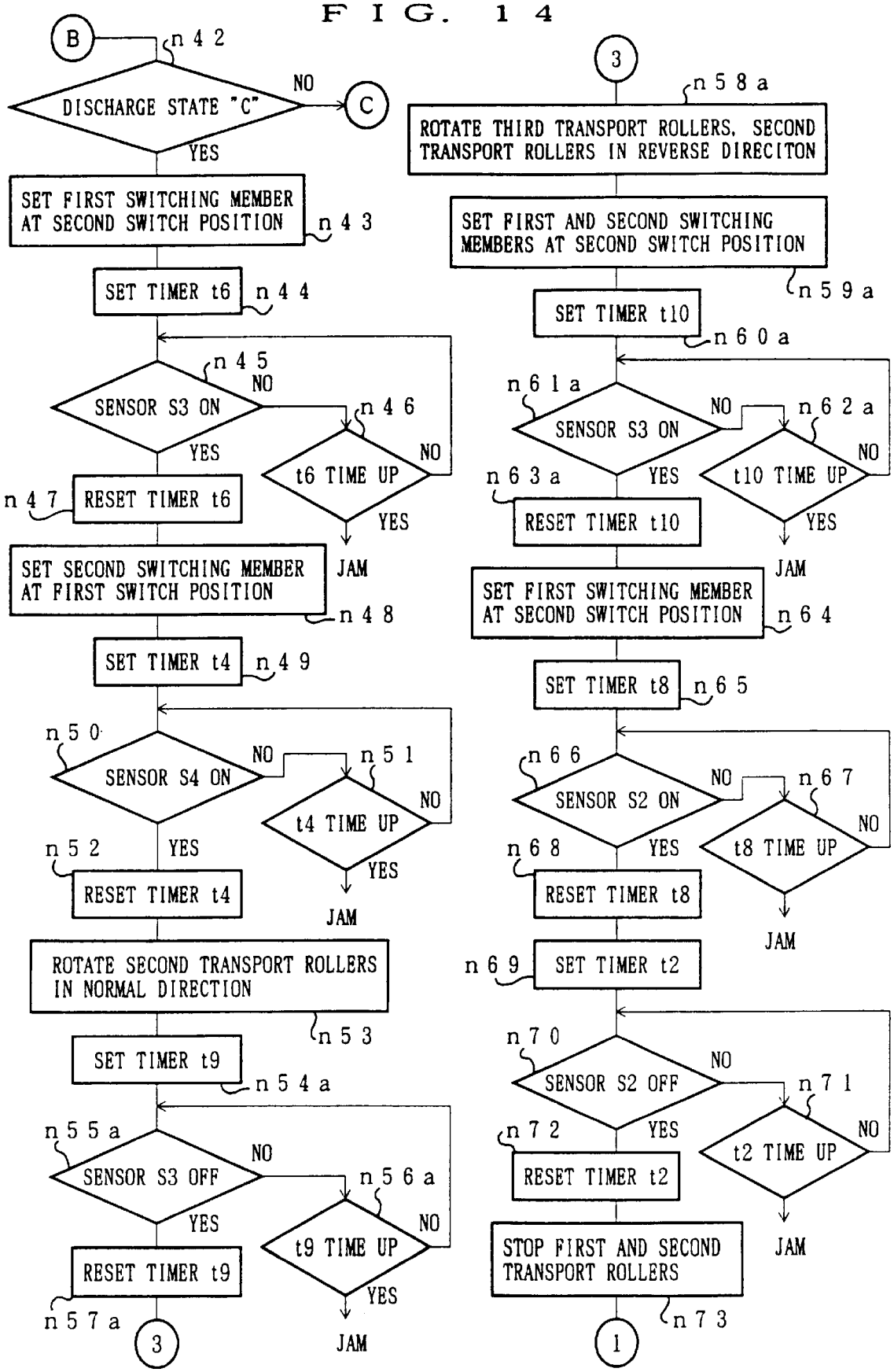
FIG. 14 which shows another process of controlling the discharging process in the sheet post-processing apparatus is a flowchart showing a process of discharging a sheet in accordance with another example of the controlling process of FIG. 13.

FIG. 14 shows a control flowchart which differs from that shown in FIG. 13 only in and after n54. Namely, the sheet P having an image formed thereon is guided by the first switching member 55, and is fed into the branched transport path 56. Further, the sheet P is guided to the second transport rollers 58 by the second switching member 57 via the third transport rollers 63. Here, the second transport rollers 58 are driven to rotate in a normal direction (n53), and the timer t9 is set for controlling if the rear end of the sheet P has passed through the sensor S3 (n54*a*). Then, the state of the sheet P being transported through the branched transport path 56 is controlled by the processes in n55*a*→n56*a*→n55*a*. If the time period set by the timer t9 has elapsed before detecting the rear end portion of the sheet P by the sensor S3 (OFF state), the sequence goes to the routine for processing the jammed sheet.

In the described transport state, if the sheet P is being transported properly, at the timing the sensor S3 detects the rear end of the sheet P, the timer t9 is reset (n57*a*), and the third transport rollers 63 is driven to rotate in a reverse direction (n58*a*). In the meantime, the second transport rollers 58 also rotate in a reverse direction. As a result, the sheet P is switched back, and the rear end of the sheet P comes first, and the reverse transportation is started. In the meantime, the first switching member 55 is kept at the first switch position, while the second switching member 57 is set to the second switch position (the respective states shown in FIG. 7(*c*) and FIG. 7(*d*), and especially the transport state shown in FIG. 7(*d*)) (n59*a*). This arrangement is for preventing the transportation of the sheet P from being disturbed by the film 57*a* of the second switching member 57 when switching back the sheet P.

After performing the described transporting operation, the timer t10 is set (n60*a*). The timer t10 is set in a short time for the following reasons. When the sheet P is fed into the branched transport path 56, the rear end is detected by the sensor S3 (OFF), and the switch back transportation is performed mainly by the third transport rollers 63, and thus the sensor S3 is set ON immediately. Therefore, when the normal switch back transportation is applied properly to the sheet P, the sheet P can be detected immediately by the sensor S3 (ON state). Therefore, by carrying out the controlling processes in n61*a*→n62*a*→n61*a*, if an abnormality is not detected, the timer t10 is reset (n63*a*).

Thereafter, the same control as in and after n64 in FIG. 13 can be performed. In this case, the first switching member 55 is set to the second switch position in n64, and as explained earlier, the switching control is performed in n59*a*. As described, the sheet P is reversed and discharged in order onto the first discharge tray 53 with an image forming surface facing downwards. Therefore, the sheets P having an image formed thereon are aligned in the sending order of the image data.

In this case, by arranging such that the switch back transportation of the sheet P is started mainly by the third transport rollers 63 along the branched transport path 56, the necessity that the end of the sheet P being transported completely to the second transport path 61 can be eliminated, thereby reducing the time required for the switch back. This permits the stand-by time of the next sheet P being held between the sheet entry rollers 50 can be reduced or even eliminated.

According to the described embodiment, by providing the third transport rollers 63 for use in performing a switch back transportation, the need of separately providing the transport path can be eliminated. Moreover, the length of the branched transport path 56 can be increased, and the reverse transport control can be performed with ease even in the case where the distance between the first and second transport rollers 52 and 58 is above the length of the minimum size sheet that can be processed. Especially, the distance between the first and second transport rollers 52 and 58 is increased, so as to ease the removal of the sheet P discharged onto the lower discharge tray 59 by the operator by increasing an interval between the upper and lower discharge trays 53 and 59.

Before confirming that the discharge state "C" corresponding to the printer mode is selected, all the image data being transferred are stored, and if the copying machine main body 1 has a sufficient memory capacity for forming an image from the last page, the discharge mode is altered from the discharge mode "C" to the discharge mode "A", and the discharge mode "A" is confirmed to execute a discharging process of the sheet P.

The described processes are as explained in reference to FIG. 11, and the explanations on the discharge process are omitted.

The above descriptions have explained the discharge process of the sheet having an image formed thereon by the sheet post-processing apparatus 5 according to the set display shown in FIG. 8, a discharge end, i.e., the discharge state is set as desired according to the image forming mode.

For various image forming modes of the described digital copying machine, the discharge states A through D to be confirmed are merely the examples, and the discharge states can be set by the user as desired. For example, in the fax mode, the discharge state "C" may be selected in which the sheet P is discharged to the second discharge tray 59 without being reversed, and the sheet P is reversed and discharged to the first discharge tray 53 as in the printer mode.

Moreover, explanations have been given through the case where the discharge trays are provided in two levels. However, this indicates at least the two discharge trays of two levels are required, and more than two discharge trays may be provided, and the discharge end may set as desired according to the image forming mode, and the discharge process can be performed. For example, in the case where the discharge trays are provided in three levels, the sheet P is discharged to each discharge tray in the same direction as sheet P being transported to the sheet P discharged from the copying machine main body 1. On the other hand, a sheet P can be reversed by using another discharge tray. By arranging so, a sheet post-processing apparatus 5 which permits a discharge process of the present invention can be achieved.

It may be arranged such that the sheet P having an image formed thereon is not discharged directly onto the tray but sent back to an image forming section, and a subsequent sheet P having an image formed thereon can undergo a post-processing operation. In this case also, in order to return the sheet P to the digital copying machine main body 1, one of the first and second discharge trays 53 and 59 is selected. Namely, in the image forming mode, when the double-sided copy mode is selected, which one of the first or second discharge trays 53 and 59 is to be selected is set beforehand, and upon completing an image forming process on both sides of the sheet P, the sheet P is discharged onto the discharge tray as selected.

For the tray for use in the double-sided copy mode in which a sheet P is to be reversed, it is important to select a tray which is outside of the operator's sight. For this purpose, it is appropriate to select the second discharge tray 59 of the lower level as the reverse processing section than the first discharge tray 53. As to the tray for receiving sheets having an image formed thereon, it is appropriate to select the discharge tray of the upper level.

[Double-Sided Copy Mode: Switch Back Reverse Feeding/ Discharge State "E"]

Here, the processes of controlling a sheet P utilizing a sheet post-processing apparatus 5 in the case of performing an image forming process in the described double-sided copy mode will be explained.

Here, the need of providing a reverse transport path for reversing a sheet P in a copying machine main body 1 can be eliminated by utilizing the member in the sheet post-processing apparatus 5. For this reason, the transport path for the sheet P in the copying machine main body 1 can be simplified, and the copying machine main body 1 can be reduced in size.

Figure 15:
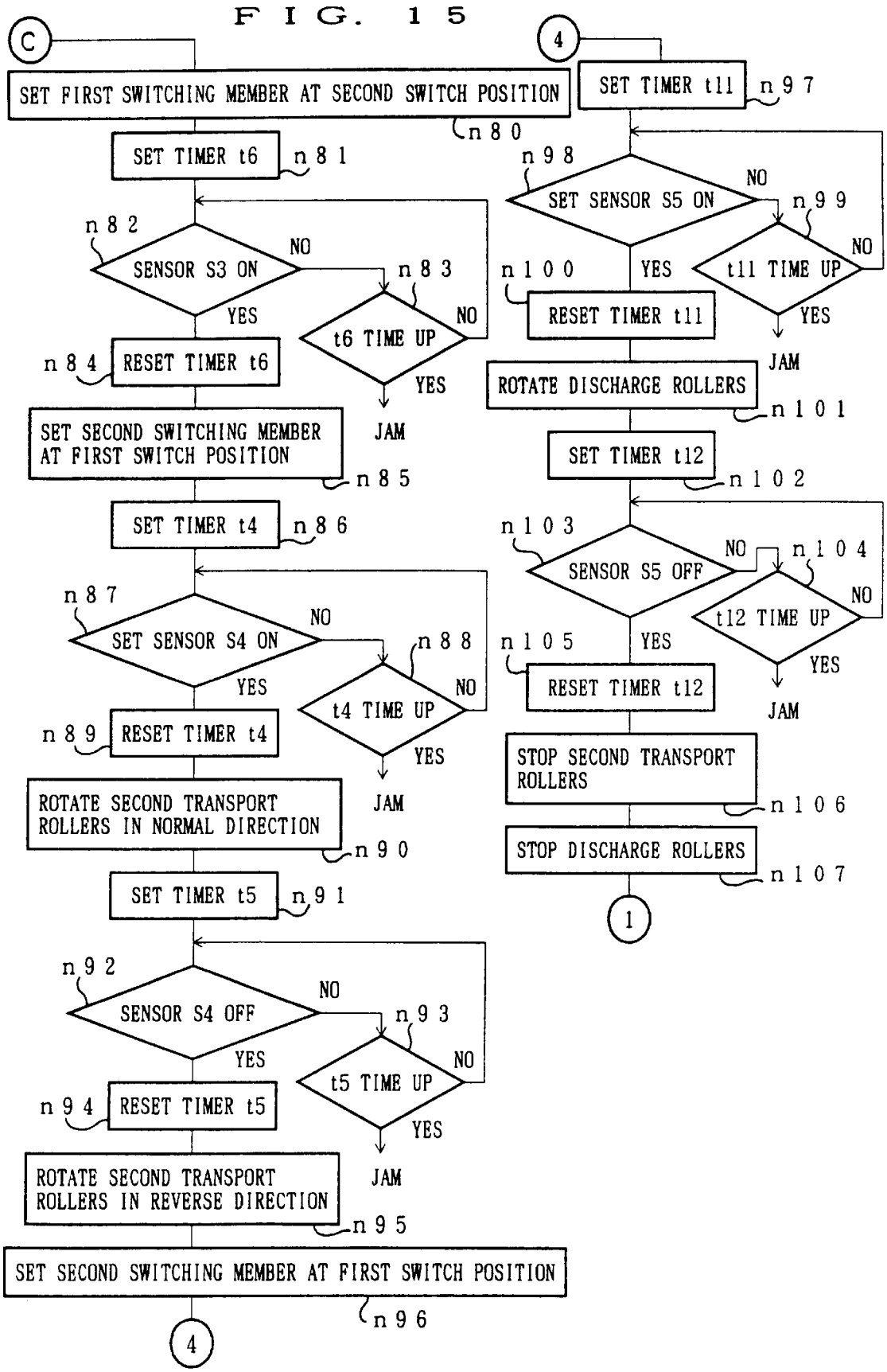
FIG. 15 which shows another process of controlling a discharging operation in the sheet post-processing apparatus is a flowchart showing a process of controlling a discharging process of a sheet particularly in a discharge state corresponding to a both-sided mode of the digital copying machine.

In the double-sided copy mode, the sheet P is sequentially discharged at a predetermined interval through discharge rollers 4 of a sheet discharge opening of the copying machine main body 1. The sheet P being sequentially discharged is received by the feed rollers 50 through the sheet entrance opening 5*a* of the sheet post-processing apparatus 5. Here, upon detecting the leading end portion of the sheet P by the first sensor S1, provided that the discharge state "E" corresponding to the double-sided copy mode is selected, after carrying out the processes shown in the flowcharts of FIG. 11, FIG. 12 and FIG. 13, and finally the controlling processes shown in FIG. 15 are executed, and the first switching member 55 is set to the second switch position (n80).

Then, the timer t6 for controlling the transport state of the sheet P is set, and the time set in the timer t6 controls the transportation of the sheet P being transported to the branched transport path 56 via the first switching member 55 is controlled based on the time required for detecting the leading end portion of the sheet P (n82→n83→n82). If the sensor S3 does not detect the leading end portion of the sheet P, i.e., if it is not the ON state, within the time set by the timer t6, it is determined that an abnormality in transporting the sheet P has occurred, and the sequence goes to the routine for processing the jammed sheet.

When the sensor S3 detects the leading end portion of the sheet P (ON state), the timer t6 is once reset (n84). Then, in order to transport the sheet P to the second discharge section 60 (especially, in the direction of the second transport rollers 58), and the second switching member 57 is set to the first switch position (see the position of FIG. 7(*a*)) (n85), and a new timer t4 is set (n86).

If the sensor S4 detects the leading end portion of the sheet P (ON) within the time set by the timer t4, the second transport rollers 58 are driven to rotate in a normal direction (n90), and the timer t4 is reset (n89). Here, the timer t4 controls the sheet P being transported to the second transport rollers 58 via the second switching member 57 based on the time required for detecting the leading end portion of the sheet P by the sensor S4 (n87→n88→n87). Therefore, if the time set by the timer t4 is up before the sensor S4 detects the leading end portion of the sheet P (OFF state), it is determined that an abnormality in transporting the sheet P has occurred, and the sequence goes to the routine for processing the jammed sheet.

Here, if the sheet P is being transported properly, the sensor S4 detects the leading end portion of the sheet P before the time set in the timer t4 is time up (ON state), and the second transport rollers 58 are driven to rotate in a normal direction in n90. Thus, the sheet P is fed into the second discharge tray 59. After the timer t5 is set (n91), if the sensor S4 detects the rear end portion of the sheet P within the time set by the timer t5, it is determined that the sheet P is being transported properly, and the timer t5 is reset (n94). Here, the timer t5 controls if the transport state of the sheet P (n92→n93→n92). On the other hand, if the sensor S4 does not detect the rear end portion of the sheet P within the time set by the timer t5, i.e., it is not in the OFF state, it is determined that an abnormality in transporting the sheet P has occurred, and the sequence goes to the routine for processing the jammed sheet.

When the sheet P is being transported properly by the second transport rollers 58, and the rear end of the sheet P is detected by the sensor S4 (OFF state), as described, the timer t5 is reset (n94) and the second transport rollers 58 are driven in a reverse direction (n95). Here, the second switching member 57 is maintained at the first switch position (n96). Then, as shown in FIG. 7(*b*), the sheet P is transported. Therefore, by the reverse driving of the second transport rollers 58, the sheet P is switched back to be transported along the second transport path 61 to the retransport path 38 of the copying machine main body 1.

For the processes shown in the flowchart of FIG. 15, the processes in n80 through n95 are the same as the processes shown in n43 through n58 shown in the flowchart of FIG. 13. Thus, the processes shown in FIG. 15 are the same as the processes shown in FIG. 13 up to the processes of transporting the sheet P to be switched back. However, in the double-sided copy mode, in order to send the sheet P to the copying machine main body 1, the sheet P is transported along the second transport path 61 without being guided to the branched transport path by the second switching member 57. In order to control the state of the sheet P being switched back, the timer t11 is set. This timer t11 controls the state of the sheet P being transported in the processes of n98→n99→n98. If the sensor S5 does not detect the leading end portion of the sheet P within the time set by the timer t11, it is determined that an abnormality in transporting the sheet P has occurred, and the sequence goes to the routine for processing the jammed sheet.

If the sheet P is being transported properly, the sensor S5 detects the leading end of the sheet P, and the timer t11 is reset (n100), and the discharge rollers 62 placed on the downstream side of the sensor S5 is driven to rotate in a direction of transporting the sheet P to the copying machine main body 1 (in a normal direction) (n101). In fact, the discharge rollers 62 is driven beforehand. For example, it may be arranged such that the discharge rollers 62 start driving when the sensor S1 detects the leading end of the sheet P.

When the sheet P starts being transported through the discharge rollers 62, a timer t12 is set to control if the sheet P is being transported properly to the retransport path 38 of the copying machine main body 1 (n102). This timer t12 also controls the transport state of the sheet P being transported in the processes of n103→n104→n103, and if the sensor S5 does not detect the rear end portion of the sheet P within the time set by the timer t12, i.e., it is not in the OFF state, it is determined that an abnormality in transporting the sheet P has occurred, and the sequence goes to the routine for processing the jammed sheet.

If it is determined that the rear end portion of the sheet P has passed the sensor S5 properly, the timer t12 is reset (n105), and upon confirming that the rear end of the sheet P is discharged from the discharge rollers 62, the second transport rollers 58 and the discharge rollers 62 stop driving (n106 and n107). As explained earlier, it may be arranged such that the second transport rollers 58 and the discharge rollers 62 are kept driving without stopping. However, in order to transport the next sheet P to be switched back, it is important to drive the second transport rollers 58 in a normal direction. Namely, when the second transport rollers 58 are driven properly in a normal direction, if the rear end portion of the sheet has passed the sensor S4 when transporting the sheet P to be switched back, even if the next sheet P is fed into the second transport rollers 58 by the second switching member 57, the situation can be managed.

As described, in the double-sided copy mode, by utilizing the lower second sheet discharge section 60, the sheet P is transported to be switched back by reversing the sheet P, and is fed into the retransport path 38 on the side of the copying machine main body 1 to be guided to the intermediate tray. Therefore, the sheet P having an image formed on one side thereof is placed on the intermediate tray with an image forming screen facing upwards. In order to feed the sheet P to the intermediate tray, the second discharge tray 59 is used. However, it may be arranged so as to feed the sheet P by the first discharge section 54 having the first discharge tray 53. In this case, the first switching member 55 is set to the first switch position (the position shown in FIG. 6(*a*)), and the rotating direction of the first transport rollers 52 is switched when carrying out a switch back transportation. Then, as the second switching member 57 is set to the second switch position (the position shown in FIG. 7(*c*)), the sheet P is guided directly to the discharge rollers 62 via the branched transport path 56, to be fed into the intermediate tray 38 with an image forming surface facing upwards.

Especially, as shown in FIG. 15, when transporting the sheet P by being switched back to be fed into the intermediate tray of the retransport path 38 of the copying machine main body 1, as the transport path is formed in a straight line, the transport state is stabilized, thereby achieving the effects of reducing the occurrence of an abnormality in transporting the sheet P. Such straight transport path also offers high speed process by driving at a higher speed than the switched back transportation.

Additionally, in order to feed the sheet P into the intermediate tray of the retransport path 38, the need of sequentially providing the switch back path, etc., for transporting the sheet P in a reverse direction to the copying machine main body 1 is eliminated. Moreover, as the discharge section for receiving the sheet P discharged from the copying machine main body 1 serves as the switch back transport path, the sheet post-processing apparatus 5 performs not only a post-processing on the sheet P but also switch back reverse transportation for double-sided copying.

For example, when the double-sided copy mode is selected in a copy mode, after images to be formed on the first surface of the sheet P are formed on all the sheet P, the sheet P is discharged. Namely, if there exists an even number of single-sided documents, all the images on pages of even numbers have been read, and an image forming operation is performed thereon. Then, the sheet P having an image formed thereon is stacked in the order of even page numbers onto an intermediate tray placed on the retransport path 38. Therefore, an image reading operation is performed from the pages of odd numbers, and the sheet P is sequentially transported from the intermediate tray to undergo an image forming process. Then, images on pages of odd numbers of the sheet P are formed on the surfaces opposite to the surfaces whereon images on the pages of even numbers have been formed. Then, the sheet P having images formed on both sides is sent to the sheet post-processing apparatus 5 to be directly guided to the first discharge tray 53.

In this state, the sheet P is discharged with an image forming surface facing upwards. Moreover, as it is arranged so as to form an image from the last page, the sheet P can be discharged without being scattered. In this case, as the sheet P having images formed on both sides is discharged onto the first discharge tray 53 while the sheet P is being transported to the intermediate tray along the retransport path 38 in a reverse direction by utilizing the second sheet discharge section 60 having the second discharge tray 59, the sheet having an image formed on one side is not mixed with the sheet having images on both sides.

Especially, in the double-sided copy mode (double-sided image forming mode), when it is operated in a printer mode or fax mode, upon giving a request for a double-sided copying operation, the sheet P is transported in a reverse direction by switching back using the second discharge section 60 to be fed into the image forming section via the retransport path 38, and the sheet P having an image formed on both surfaces is discharged along the straight transport path onto the first discharge tray 53. As described, the sheet P is transported by alternately switching the discharge end between the second discharge tray 59 and the first discharge tray 53. Thus, the sheet P having an image formed on both sides is not mixed with the sheet P having an image formed on one side, and the respective directions of feeding the sheet P by the branched transport path 56 are not overlapped.

In the case where the third transport rollers 63 are formed, especially in the case where the first and second transport rollers 52 and 58 are arranged so as to be rotatable in a reverse direction to enable the reverse transportation of the sheet P, and the third transport rollers 63 are also arranged so as to be rotatable in a reverse direction to enable the reverse transportation of the sheet P, it is especially convenient to allocate respective roles of the transport rollers 52, 58 and 63 when carrying out a switch back transportation of the sheet P.

For example, it may be arranged such that the first transport rollers 52 are used for a switch back transportation for reversing the sheet P to be discharged onto the second discharge tray 59 only, the second transport rollers 58 are used for a switch back transportation for feeding the sheet P to the retransport path 38 in the copying machine main body 1 for forming images on both sides only, and the third transport rollers 63 are used for a switch back transportation for reversing the sheet P to be discharged onto the first discharge tray 53 only. As a result, when the operator selects a tray to be used or a both sided mode, the control process thereof can be performed in a simple manner.

Moreover, by performing the described switch back transportation, a continuous operation can be performed at a shorter interval between the sheets P. Namely, the sheet P is not transported wastefully along the transport path, and the sheet P can be transported in a reverse direction in a simple manner.

According to the arrangement of the present embodiment, the sheet post-processing apparatus 5 can be used not only when forming an image on both sides of the sheet but also when performing a composite copying, in which images are formed so as to be overlapped on the one surface of the sheet P a plurality of times. Namely, by driving the feed rollers 50 and the discharge rollers 62, the first switching member 55 is set to the second switch position, while the second switching member 57 is set to the second switch position. As a result, the transportation of the sheet P having an image formed thereon is switched in a middle of the first transport path 51, and is guided to the discharge rollers 62 by the second switching member 57 via the branched transport path 56 to be fed into the intermediate tray of the retransport path 38 with an image forming surface facing downwards. Therefore, when the sheet P is transported to the image forming section via the intermediate tray, a toner image is transferred again onto the surface having an image formed thereon. As a result, different images are formed on the same surface.

Even in the described case, an image can be formed by compositing utilizing the transport path required in the sheet post-processing apparatus 5. In this case, it is not required to drive the first and second transport rollers 52, 58, etc., nor it is not required to switch the switching member in the middle. Furthermore, by setting the distance of transporting between the feed rollers 50 and the discharge rollers 62 for the length of the minimum size sheet P that can be processed, the need of the third transport rollers 63 can be eliminated. This feature offers an effect of reducing the size of the sheet post-processing apparatus 5.

As explained, when forming an image on both sides, the process of transporting the sheet P back to the copying machine main body 1 is performed utilizing the second discharge section 60, especially the second discharge tray 59. In this case, the operator cannot observe the sheet P being projected as being hidden by the upper first discharge tray 53, thereby eliminating an occurrence of a jammed sheet by eliminating the sheet P on purpose. As a result, the sheet P can be reversed for sure by surely guiding the sheet P back to the retransport path 38 of the copying machine main body 1. Additionally, as the sheet P having an image formed thereon is discharged onto the first discharge tray 53, even if the sheet P is removed, a problem of a jammed sheet being discharged even after the removal of the sheet P is eliminated.

Therefore, in the case where the digital copying machine is operated in the double-sided image mode, the discharge state "E" is selected. Namely, the first discharge tray 53 is selected for discharge end of the sheet P, while the second discharge tray 59 is selected as a reverse transport section for transporting the sheet P back to the retransport path 38 of the copying machine main body 1.

On the contrary, an operation mode wherein the first discharge tray 53 is selected as a reverse section for transporting the sheet P back to the copying machine main body 1, and the second discharge tray 59 is selected as the discharge end of a sheet P having images formed on both sides may be selected as a discharge state "F". For the discharge end of discharging the sheet P having images formed on both sides, the first discharge tray 53 may be selected. Furthermore, in the discharge state E, the second discharge tray 59 may be selected as the discharge end of the sheet P having an image formed on both sides.

[Another Embodiment showing Sheet Discharging Operation of the Present Invention]

The above-explanations have been given through the case of selecting the discharge end of the sheet P having an image formed thereon beforehand as desired, and performing a discharging process on the selected discharge tray as desired. Namely, in respective image forming modes, discharge trays are selected beforehand. Therefore, the sheet P having an image formed thereon is stacked on the discharge tray in such a manner that the troublesome classification thereof is required.

In order to eliminate the described problem, on the side of the sheet post-processing apparatus 5, the discharge tray is selected by the sheet post-processing apparatus 5 in accordance with the discharge state of the sheet P, and concrete examples will be given for simplifying the classification of the discharged sheets. To confirm the tray of the discharge end, the explanations will be given through the limited case where the digital copying machine is operated in the fax mode or the printer mode.

Figure 16:
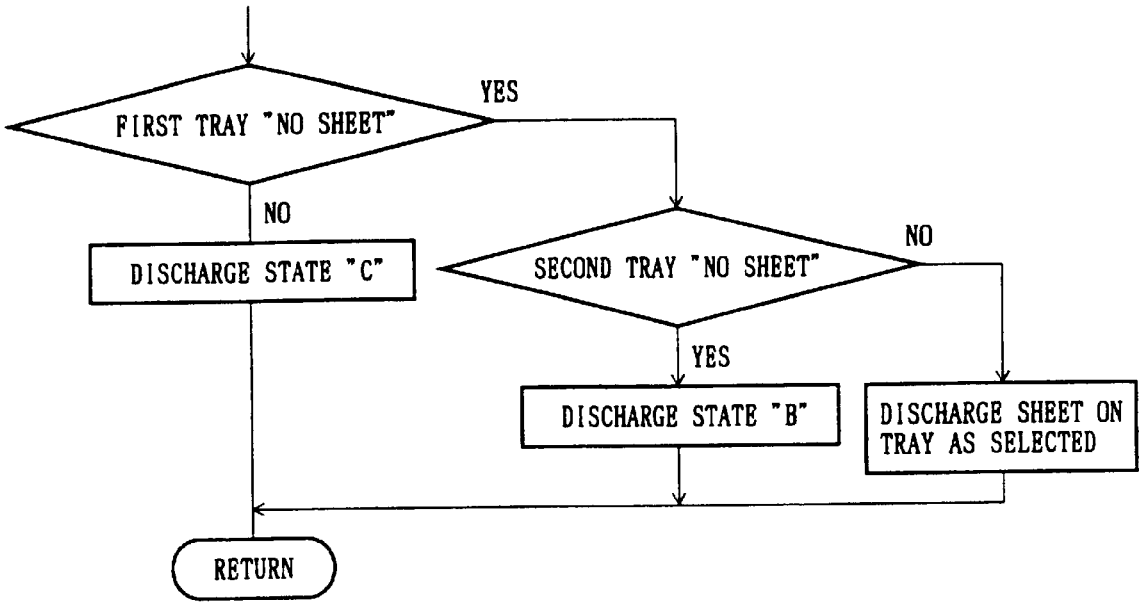
FIG. 16 which shows a process of confirming a sheet discharge state of the sheet post-processing apparatus is a flowchart showing another controlling process of the controlling process shown in FIG. 10.

As shown in FIG. 1, sensors S6 and S7 for respectively detecting the existence of the sheet P on the first and second discharge trays 53 and 59 are formed separately. Then, as shown in FIG. 16, when the copying machine main body 1 starts operating, in the sheet post-processing apparatus 5, it is confirmed if the sheet P exists on the first discharge tray 53 by the detection sensor S6. Then, if it is confirmed by the sensor S6 that the discharged sheet P does not exist on the first discharge tray 53 (OFF state), it is confirmed that the discharge state "C" is selected for discharging the sheet P, and the discharge processes shown in the flowchart of FIG. 13 are executed.

When the detection sensor S6 detects that the sheet P exists on the first discharge tray 53 (ON state), it is confirmed by the detection sensor S7 if the discharged sheet P exists on the second discharge tray 59. Here, if the existence of the sheet P is not detected by the detection sensor S7 (OFF), it is confirmed that the discharge state "B" is selected for discharging the sheet P. As a result, as explained in reference to FIG. 12, the sheet P being fed into the sheet post processing apparatus 5 is sequentially discharged onto the second discharge tray 59 by utilizing the first discharge tray 53 as the reverse processing section.

As described, by executing the process after confirming the empty state of the tray, the aforementioned problem that the sheet P is stacked onto the discharged sheet P in such a manner that classification thereof is required can be solved. Therefore, the discharged sheet P can be removed from the tray without requiring the classification of the discharged sheet P by the operator.

Moreover, upon detecting the existence of the sheet P on the second discharge tray 59 by the sensor S7, a discharge process is performed for discharging the sheet P onto the discharge tray selected beforehand, for example, as shown in FIG. 8. Namely, in the case where the sheet P is discharged onto the first and second discharge trays 53 and 59, a discharge state for discharging the sheet P onto the discharge tray selected in accordance with the fax mode or the printer mode is confirmed, and the discharge processing control is executed.

In this case, as the sheet P to be discharged is stacked onto the sheet P having an image formed thereon, the classification thereof is needed. However, upon detecting the existence of the discharged sheet P prior to performing a discharge process, in order to distinguish the discharged sheet P from the sheet P being discharged in a simple manner, a blank sheet without an image formed thereon is first discharged onto the discharge tray 53 or 59 before discharging the current sheet P, and then the sheet P having an image formed thereon in the image forming mode is placed thereon.

Alternately, also in the copy mode, it may be arranged such that between the discharge trays 53 and 59, the one on which the sheet P has not been discharged is selected and confirmed to be the discharge tray of discharge end of the sheet P. Namely, in the copy mode, if the sheet P on the first discharge tray 53 is not detected by the detection sensor S6, it is confirmed that the discharge state A is selected in the discharge section to execute the discharge process shown in the flowchart of FIG. 11. Additionally, in the case where the sheet P having an image formed thereon is discharged onto the first discharge tray 53, if the detection sensor S7 confirms that there exist no sheet P having an image formed thereon on the second discharge tray 59, the discharge state "D" is selected, and a discharge process shown in FIG. 15 is executed. Moreover, if it is detected that there exists the sheet P on the first and second discharge trays 53 and 59, it is confirmed that the discharge state corresponding to each image forming mode explained in reference to FIG. 9 is selected to execute the discharge operation.

A still another embodiment will be explained, wherein the detection sensors S6 and S7 for detecting the existence of the sheet P onto the discharge trays 53 and 59 are placed, and the discharge state is selected in accordance with the state as detected. Namely, the sheet P is discharged after being reversed in the state where the sheet P does not exist on the first and second discharge trays 53 and 59 for use in discharging the reversed sheets P. This arrangement prevents the discharged sheet P from being pushed and dropped from the tray by the sheet P being reversed.

Figure 17:
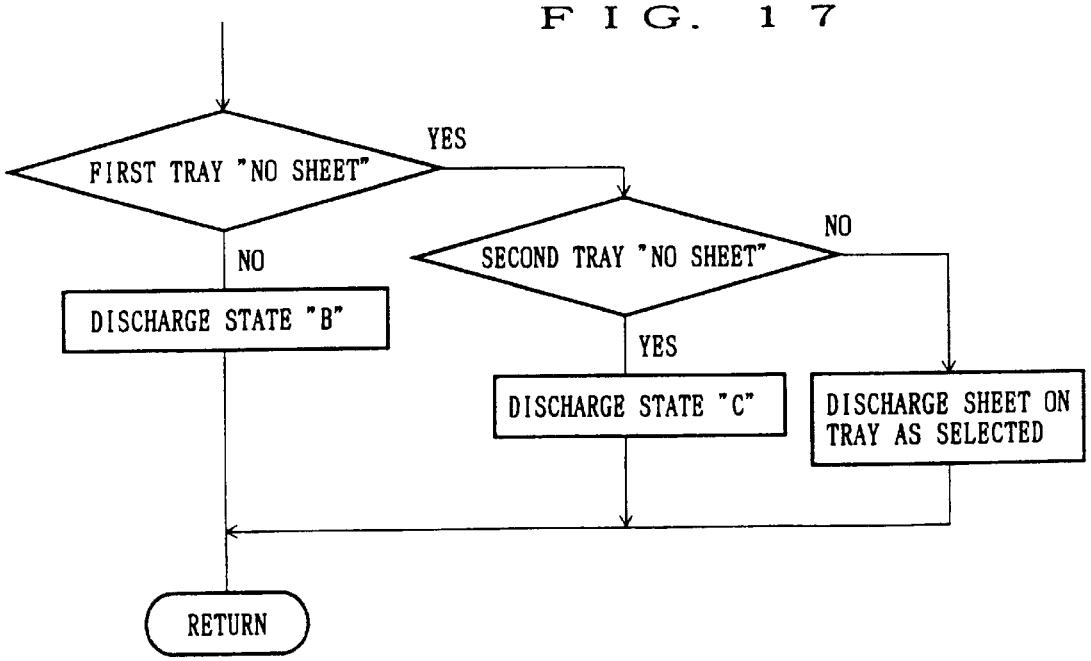
FIG. 17 which shows a process of confirming a sheet discharging state of the sheet post-processing apparatus is a flowchart showing still another controlling process.

Therefore, the processes shown in the flowchart of FIG. 17 are executed beforehand. Upon starting an image forming operation, if it is detected that the sheet P does not exist on the first discharge tray 53, it is confirmed that the discharge state "B" is selected. As a result, the process of controlling a sheet discharging operation onto the second discharge tray 59 shown in FIG. 12 is executed by using the first tray 53 on which the discharged sheet P does not exist as a sheet reversing section. Therefore, such problem that the discharged sheet P is pushed and dropped from the tray can be eliminated.

On the other hand, if the discharge sheet exists on the first discharge tray 53, it is confirmed if the sheet P exists on the second discharge tray 59. If the sheet P is not detected, it is confirmed that the discharge state "C" is selected. Then, the sheet P being sent to the sheet post-processing apparatus 5 is discharged onto the first discharge tray 53 by using the second discharge tray 59 as a reverse processing section as shown in FIG. 13.

In the case where the discharged sheet P exists on both of the trays 53 and 59, the sheet P may be discharged onto the discharge tray set beforehand, for example, as shown in FIG. 8.

In this case also, if there exists the discharged sheet P, in order to distinguish the sheet P being subjected to a new image forming process to be currently discharged from the discharged sheet P, a blank sheet without having an image formed thereon is discharged before discharging the current sheet P, and after the blank sheet is discharged, the sheet P having an image formed thereon is discharged to be stacked thereon.

In the described arrangement, by making the blank sheet distinguishable from the sheet P having an image formed thereon by forming different corners or in different patterns, the classification can be made easily. To enable this, it is desirable to separately prepare a feed cassette device having an identification sheet placed thereon so that the identification sheet is fed from the feed cassette device, if necessary.

[Still Another Embodiment of the Present Invention]

In the present invention, various discharge states are set in accordance with image forming modes of the digital copying machine. Moreover, it may be arranged so as to automatically confirm the discharge state according to an external device.

Figure 18:
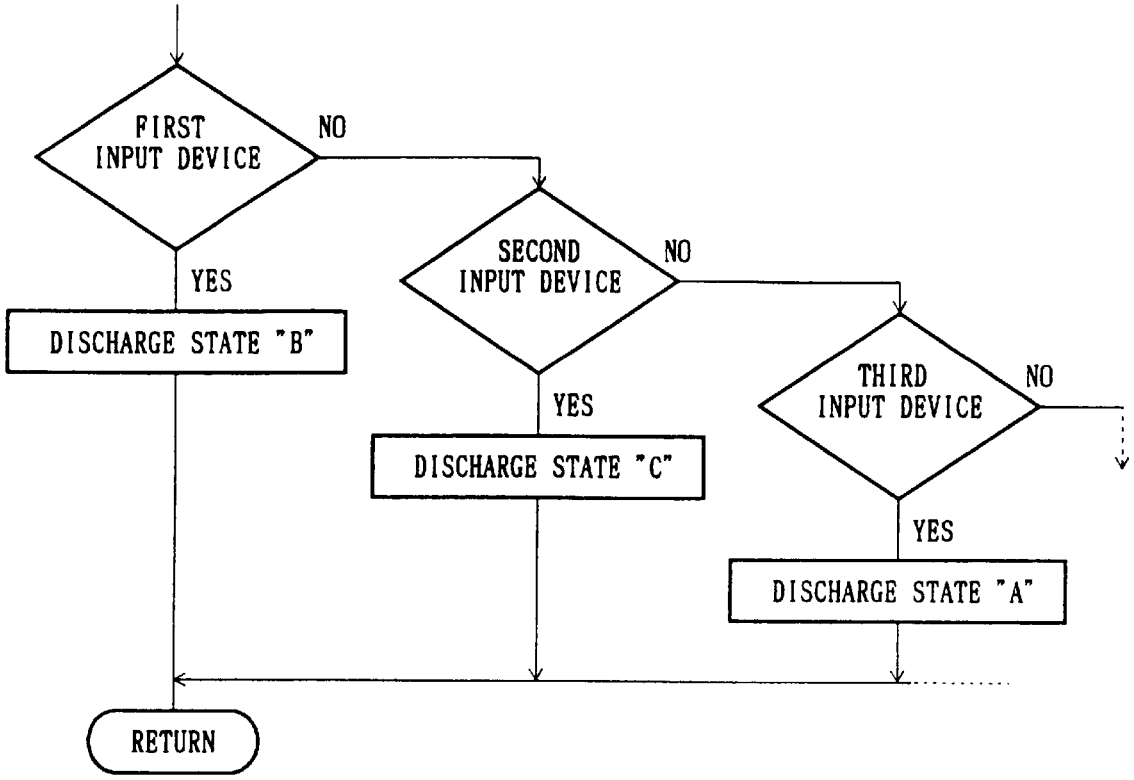
FIG. 18 which shows a process of confirming a sheet discharging state of the sheet post-processing apparatus is a flowchart showing yet still another controlling process.

To be specific, for the external device, in the case of outputting the image data from the personal computer, the word processor as hard copies, it is confirmed that the discharge state "B" or "C" is selected. Additionally, in the case of performing an image forming operation of the input data from the scanner section 2 in the copying machine main body 1, it is confirmed that the discharge state "A" or "D" is selected. FIG. 18 shows the flowchart of controlling operation for the described confirmation. In FIG. 18, the personal computer, the word processor, etc., are used as first and second input devices, and the scanner section 2 provided in the copying machine main body 1 is used, for example, as a third input device.

Here, before the copying machine main body 1 performs an image forming operation, the processes shown in the flowchart of FIG. 18 are executed, and the input device for making a hard copy using the printer section 3 of the copying machine main body 1 is searched. In the case of processing the transferred image input from the first input device such as the personal computer, it is confirmed that the discharge state "B" is selected. On the other hand, in the case of processing the transferred image input from the second input device, such as the word processor, it is confirmed that the discharge state "C" is selected. Then, in the case of processing the transferred image input from the third input device such as the scanner 2, it is confirmed that the discharge state "A" is selected. By the described confirmation, the controlling process in each discharge state is executed.

According to the described arrangement, a discharge state can be selected as desired, and in accordance with the various input devices such as the external devices or the scanner section 2 of the copying machine main body 1, discharge states are confirmed respectively, and the sheet P discharged onto a predetermined discharge tray 53 or 59 can be taken out with ease.

[New Development of the Present Invention]

According to the above explanations, in the copy mode in which an image is recorded on one side of the sheet P, a printer mode and a fax mode in which a received image is recorded, and further a double-sided or a composite mode in which an image is recorded on both sides or on the same side, the discharge end of the sheet P on which the last image has been printed, or the switch back transporting portion for switching back the sheet P are confirmed.

However, in each image forming mode, a discharge end of discharging the sheet P having an image printed thereon and then a switch back transporting portion for discharging the sheet P can be selected as desired.

Namely, the sheet P having an image printed thereon in the fax mode is discharged on the first discharge tray 53, and the sheet P having ah image printed thereon is discharged onto the second discharge tray 59 in the printer mode. Alternatively, the sheet P having an image printed thereon in the printer mode or the fax mode can be discharged onto the second discharge tray 59. This is enabled by setting an initial setting value in a simulation mode as an initial setting value. The initial setting value becomes effective by storing it in a memory medium in such an environment that it can be stored in data even if the power is disconnected. Upon turning on the power of the apparatus, the data is read from the memory, and the environment of the apparatus can be set to the initial state.

The sheet P is switched back by the second transport rollers 58, and is reversed to be discharged onto the first discharge tray 53. Here, since the sheet P being once discharged onto the second discharge tray 59 is placed below the first discharge tray 53, it is not very observable from the operator. This permits a smooth switch back transportation of the sheet P without touching the sheet P being projected while being switched back, or being taken out by the operator by mistake.

The same can be said for the switch back transportation for double-sided printing. Namely, the sheet P being transported to be switched back by the second transport rollers 58 becomes less observable by the operator as being hidden by the first discharge tray 53. Furthermore, in the switch back transportation for the double-sided printing, by placing the second transport path 61 for resupplying it on an extended line of the switch back transport path, sheets can be processed without suffering from a significant reduction in sheet transportation efficiency and an image printing efficiency (rate) in the double-sided printing operation.

Further, by approximating the relationship between the first discharge section 54 and the second discharge section 60 as much as possible, an improved efficiency of switching back the sheet P by the discharge section to be discharged onto the other tray can be improved.

Figure 19:
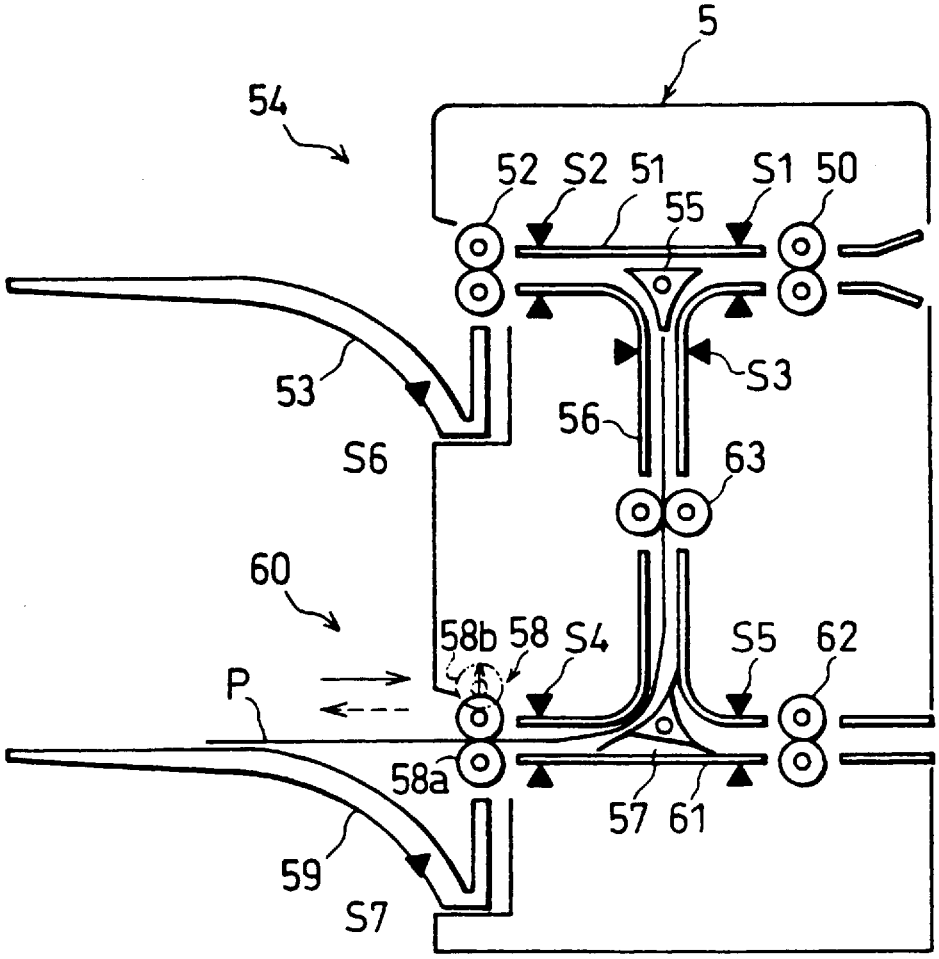
FIG. 19 is a cross-sectional view showing a switch back transport state at the second sheet discharge section in the sheet post-processing apparatus particularly when adopting a maximum size sheet.
Figure 20:
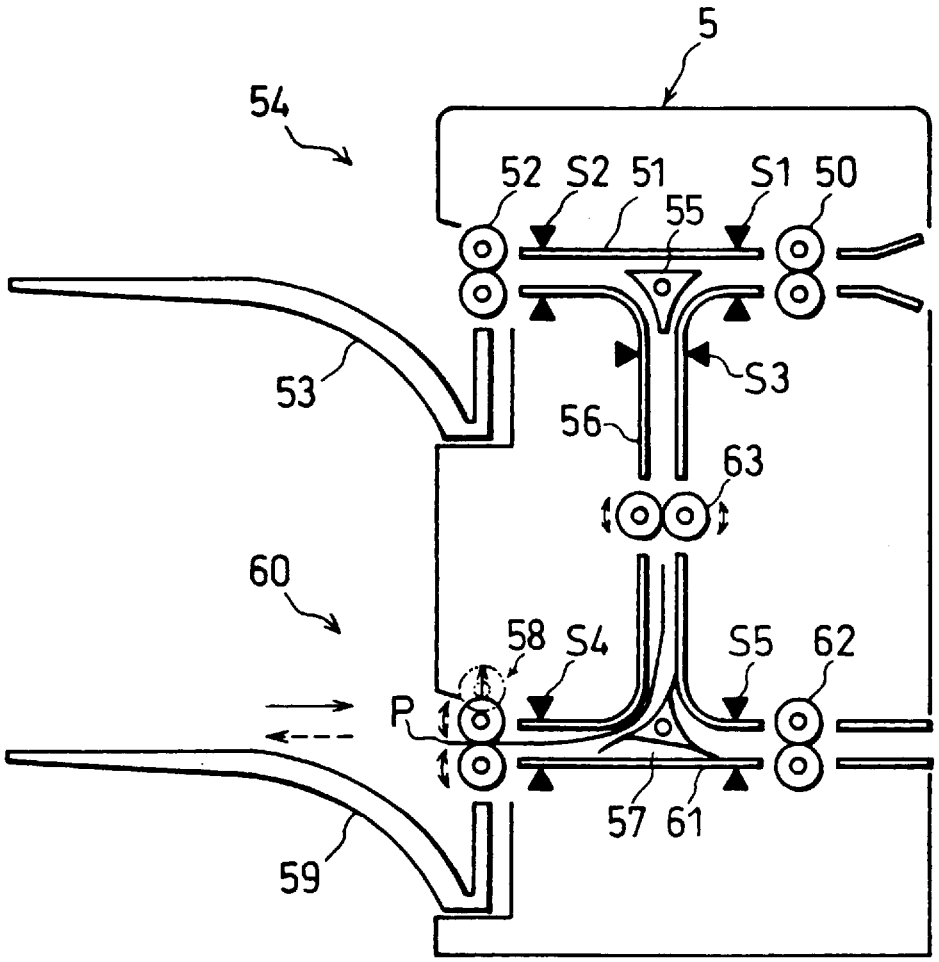
FIG. 20 is a cross-sectional view showing a switch back transport state at the second sheet discharge section in the sheet post-processing apparatus particularly when adopting a minimum size sheet.

Especially, in the case of discharging the sheet P onto the first discharge tray 53 after being reversed by switching it back at the position of the branched transport path 56, as shown in FIG. 19 and FIG. 20, even if the sheet P is small in size, or large in size, by arranging so as to start the reverse transportation of the sheet P by a switch back operation always in the state where the sheet P is sandwiched by the third transport rollers 63, and the leading end portion of the sheet P is sandwiched by the second transport rollers 58, the switch back transportation can be surely performed in an appropriate timing.

In this case, as shown in FIG. 20, in the case of processing the minimum size sheet P, by arranging such that the sheet P is sandwiched between the third and second transport rollers 63 and 58, as the distance from the position of the sensor S3 to the second transport rollers 58 can be set in accordance with the minimum size sheet P, the transport path can be shortened, thereby permitting a reduction in size of the sheet post-processing apparatus 5.

In the case where the second transport rollers 58 are positioned for the minimum size sheet P as shown in FIG. 20, irrespectively of the relative position, for sandwiching the sheet P, for example, in order to prevent the leading end portion of the sheet P to be discharged onto the second discharge tray 59 from touching the discharged sheet P on the tray 59, the second transport rollers 58 (see FIG. 19) are placed in such a position that the sheet P is not buckled, i.e., the leading end of the sheet P is not bent downwards by its dead weight (see FIG. 19), and the distance between the sensor S3 and the second transport rollers 58 can be shortened.

In this case, even if the minimum size sheet P is not sandwiched by the second transport rollers 58, it would not be a problem as long as the sheet P of the maximum size can be transported without being buckled in the projected state from the second transport rollers 58. In this case, the second transport rollers 58 are placed further from the third transport rollers 63 than the state where the minimum size sheet P is sandwiched by the second transport rollers 58; however, the effects of preventing the buckling of the sheet P can be even more appreciated.

Especially, when the sheet P is projected towards the second discharge tray 59, the sheet P already discharged onto the tray 59 can be prevented from being dropped from the tray 59. Namely, the discharged sheet P on the second discharge tray 59 can be prevented from being pushed by the sheet P being projected from the second transport rollers 58 to be dropped from the tray 59, or from being misaligned.

Further, in the case of discharging the sheet P having an image formed thereon onto the first discharge tray 53 after being reversed, the switch back transportation is performed by the second transport rollers 58 based on the detection signal of the sheet P from the sensor S4. However, as shown in FIG. 19, based on a detection signal of the rear end portion of the sheet P by the sensor S3, the switch back transport control is performed when it passes the third transport rollers 63. Additionally, in the branched transport path 56, as long as the structure required for the sensor S4 is ensured, by placing the sensor S3 on the upstream side on the transport path, the sheet P can be discharged after being reversed with a still improved efficiency.

Here, as shown in FIG. 19, the rear end portion of the sheet P being sandwiched by the third transport rollers 63 is held until it reaches the second transport rollers 58 placed in the downstream side. Here, if a difference arises in transport speed between the third transport rollers 63 and the second transport rollers 58, the difference may cause the buckling of the sheet P, or generate an extension force. It is required to arrange the third transport rollers 63 and the second transport rollers 58 such that the sheet P can be transported without being buckled in the branched transport path 56.

Here, as a pair of transport rollers which constitute the second transport rollers 58 placed on the downstream side of the third transport rollers 63 are separately provided, the sheet P being transported towards the downstream side will not be buckled in the branched transport path 56. Namely, in the case where the sheet P is being transported by the third transport rollers 63, a transport force is not applied to the sheet P by the second transport rollers 58. Here, the rollers which apart from one another are arranged such that a driven roller 58*b* in tight contact with the driving roller 58*a* is separated at a timing controlled by the sensor S4. This enables these rollers to be separated with a simple structure. Namely, when carrying out a switch back transportation, by arranging such that the third transport rollers 63 are to be driven first, a transportation inferior due to a buckling of sheet P can be avoided, thereby preventing the sheet P from distorted by being extended.

Figure 21:
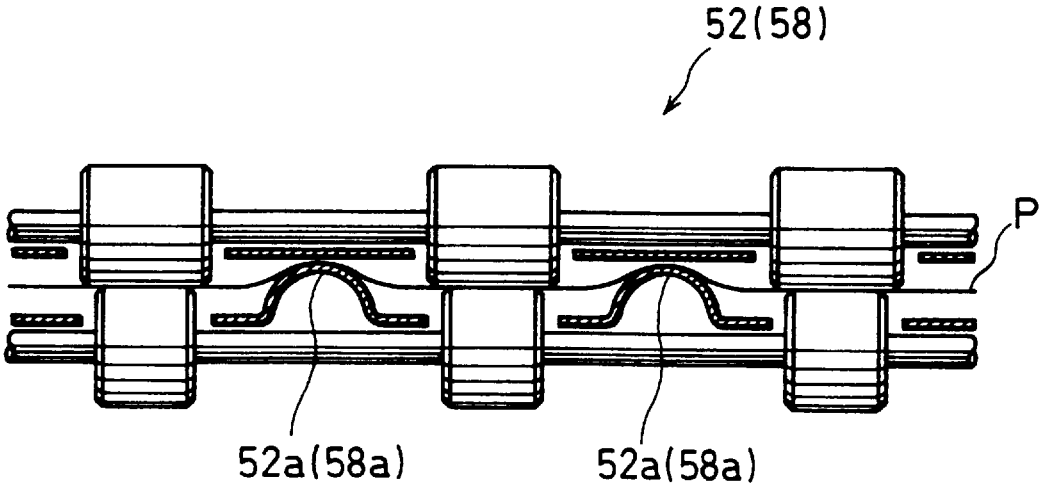
FIG. 21 is a cross-sectional view showing an arrangement where a sheet is reinforced by the first transport rollers or the second transport rollers which constitute the sheet post-processing apparatus.

In the state where the sheet P is sandwiched between the first transport rollers 52 or the second transport rollers 58, the sheet P that is once projected towards the first discharge tray 53 or the second discharge tray 59 is not buckled on the discharge tray, i.e., a storing section, as shown in FIG. 21, a reinforcing paper guide 52*a* (58*a*) which generates a wave in the sheet P being held is provided in the transport rollers 52 (58) which constitute the discharge means. As a result, a contact with the discharged sheet P on the tray can be reduced to the minimum, and the sheet P stacked on the tray can be prevented from being pushed, or being misaligned.

Figure 22:
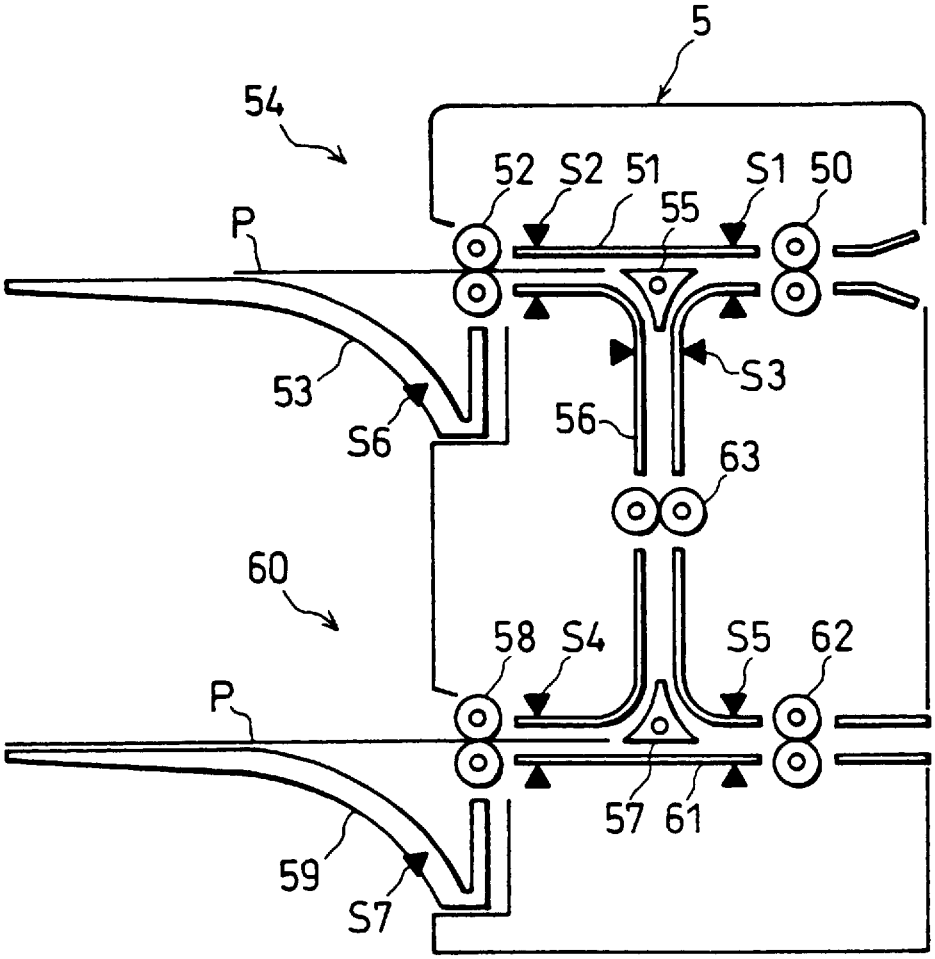
FIG. 22 is a cross-sectional view showing a state of a sheet being guided when carrying out a switch back transportation by the first or the second discharge tray which constitutes the sheet post-processing apparatus and one example of the shape of the tray.

Further, with regard to the first discharge tray 53 and the second discharge tray 59, a new development of the present invention will be explained. As shown in FIG. 22, by forming the first or second discharge tray 53 or 59 in R shape towards the leading end, i.e., in a direction of bending the base portion of respective trays 53 and 59 downwards, even if the sheet P is once being projected towards the tray, a frictional coefficient between the surface of a discharge tray and the lower surface of a sheet P can be reduced, and a damage on the image on the sheet P can be reduced. Additionally, even if other sheet P has been discharged onto the discharge tray, by a friction between the sheets P, the sheet P stored on the tray can be prevented from being dropped from the tray.

As shown in FIG. 22, the leading end portion in the discharge direction of the first and second discharge trays 53 and 59 is aligned on the extended line of the sheet P being projected from the first and second transport rollers 52 and 58, the sheet P projected to the projected portion is formed on the contact face. As a result, in the case of performing a switch back transportation by the first or second transport rollers 52 and 58, such problem that the leading end portion of the sheet P contacting the sheet P on the discharge tray 53 or 59 can be reduced to the minimum. The leading end portion of the discharged sheet P projected towards the tray may contact the projected end portion of the discharge tray; however, by reducing the contact time with the discharged sheet P, the contact with the discharged sheet P and the sheet P being discharged can be prevented. As a result, as described, by eliminating the contact state with the sheet P discharged on the tray, the discharged sheet P can be prevented from being dropped, or being scattered. Especially, the described function can be achieved only by forming the discharge tray to be substantially fit in respective positions of the first and second transport rollers 52 and 58.

As described, according to the sheet post-processing apparatus 5 in accordance with the present embodiment, as the second transport path 61 is connected to the retransport path 38 for use in forming an image on both sides of the sheet P in the digital copying machine. Therefore, in the state of discharging the sheet P onto the second discharge tray 59, by driving the second transport rollers 58 to rotate in a reverse direction, the sheet P can be transported back to the retransport path 38 for forming an image on both sides. In this case, by driving the second transport rollers 58 to rotate in a reverse direction, the sheet can be discharged onto the first discharge tray 53 by the second switching member 57 with the image forming surface facing downwards.

Therefore, the sheet P having an image formed thereon can be guided to the retransport path 38 of the copying machine main body 1 utilizing the device for discharging the sheet P onto the discharge tray after being reversed or without being reversed, thereby eliminating the need of separately providing the switch back transport path, etc., for forming an image on both sides from the copying machine main body 1, or the switch back transport path from the sheet post-processing apparatus 5. The described arrangement not only permits an image to be formed on both sides of the sheet P, but also permits the sheet P to be guided to the retransport path 38 without being guided to the first and second discharge trays 53 and 59 by the first and second switching members 55 and 57, and further permits a composite copying operation to be performed on one side of the sheet P. In this case also, it is not required to separately provide a switch back transport path.

According to the described arrangement, an image can be formed in order of image data being sent from the external device. Especially, in the case of performing a double-sided image forming operation, an image can be formed in the order of the image data being sent without altering the order of forming an image. This also eliminates the need of expanding a printing capacity for jammed recovery, etc.

By arranging the described sheet post-processing apparatus 5 such that the second transport path 61 and the retransport path 38 on the side of image forming apparatus are connected in a straight line, the sheet P can be linearly sent to the image forming apparatus after being reversed, thereby eliminating the causes of a jammed sheet. The feature that the transport path is formed in a straight line offers a high speed transportation of the sheet P.

By arranging the described sheet post-processing apparatus 5 such that the second discharge tray 59 is provided below the first discharge tray 53, the sheet P can be reversed to be discharged onto the second discharge tray 59 without having such problem that the operator removes the sheet P being discharged onto the second discharge tray 59 by mistake. The above arrangement is required in consideration of the following situation. That is, in the case of discharging a reversed sheet P onto the first discharge tray 53, or transporting a reversed sheet P through the second discharge tray 59 for forming an image on both sides, as the sheet P is hidden by the first discharge tray 53, the operator cannot confirm the existence of the sheet P by sight.

In the described sheet post-processing apparatus 5, by arranging the first and second discharge trays 53 and 59 so as to be aligned vertically and approximated to each other, the length of the branched path can be shortened. Therefore, in the case of discharging a reversed sheet onto the first discharge tray 53, or sending the sheet P to the retransport path 38 formed on the side of the copying machine main body 1, the time required for this process can be shortened. Moreover, the need of separately forming the transport means, etc., along the branched transport path 56 can be eliminated.

Furthermore, the described sheet post-processing apparatus 5 may be arranged so as to include the first transport rollers 52, wherein the sheet P discharged onto the first discharge tray 53 is reversed and is transported to the second discharge tray 59 via the branched transport path 56, or to the retransport path 38 on the side of the copying machine main body 1. Therefore, in the case where the sheet P having an image formed thereon is discharged onto the discharge tray, the operator can remove the discharged sheet P with ease. Namely, in the case of processing a reversed sheet P using the second discharge tray 59, the operator cannot remove the remaining discharged sheets. Therefore, it is arranged such that the sheet P can be revered utilizing the first discharge tray 53.

The described sheet post-processing apparatus 5 may be arranged such that the first and second transport rollers 52 and 58 are provided so as to be rotatable in a reverse direction, wherein the sheet P is transported backwards by the first transport rollers 52 or the second transport rollers 58 to be fed into the retransport path 38 of the copying machine main body 1 by the first and second switching members 55 and 57. This arrangement offers the same effect as the aforementioned arrangement, and with a selective use of the discharge tray, the previously discharged sheet P can be removed with ease.

By setting the respective functions of the first discharge tray 53 or the second discharge tray 59 in consideration of an image forming operation in the double-sided or composite mode, a still improved efficiency of discharging the sheet P, or of switching to the retransport path 38 of the copying machine main body 1 can be achieved. Namely, in the case of discharging a reversed sheet having an image formed thereon onto the first discharge tray 53, by arranging such that the sheet P is reversed in the branched path, the time required for processing can be shortened. Additionally, in the case of discharging a reversed sheet P onto the second discharge tray 59, by using the first transport rollers 52, the time required for processing can be reduced. Furthermore, in the case of transporting a sheet P to the retransport path 38, by using the second transport rollers 58, the sheet P can be sent to the retransport path 38 linearly. Therefore, a sheet transportation interval can be shortened, thereby permitting a high speed processing. Moreover, by determining a role in carrying out a reverse processing, the described control can be simplified.

According to the sheet post-processing apparatus 5 in accordance with the present invention, when transporting a reversed sheet P by the third transport rollers 63 provided in a branched transport path 56, it is especially effective to cancel the transport state of the second transport rollers 58. Namely, in the case of driving the second and third transport rollers 63, it is important to match a timing the respective rollers are driven in a reverse direction. This is because if the timing does not match, an unexpected damage or a transportation inferior may occur due to the sheet P being buckled or extended. Therefore, in the case of performing a reverse process by the third transport rollers 63, it is effective to eliminate the described problem by setting the second transport rollers 58 free.

Moreover, in order to cancel the transport state of the second transport rollers 58, it may be arranged so as to respond to a sheet detection by the sensor S4 placed in front of the second transport rollers 58, and this permits the transport state to be cancelled for sure.

According to the sheet post-processing apparatus 5 in accordance with the present invention, the second transport rollers 58 can be placed such that the leading end of the sheet P can be sandwiched by the second transport rollers 58 when transporting a reversed minimum size sheet P by the third transport rollers 63, or the leading end portion of the sheet P is not buckled by the second transport rollers 58 when transporting the maximum size sheet P. Therefore, the reverse transportation of the sheet P can be performed without having a sheet P contact the sheet P previously discharged, thereby preventing the discharged sheet P on the discharge tray from being dropped.

In this case, when the sheet P is projected towards at least the first or second transport rollers 58, the discharged sheet P can be prevented from being dropped from the discharge tray by preventing the sheet P from contacting the previously discharged sheet P by reinforcing the sheet P so that the sheet P is not buckled when being discharged onto the first and second discharge trays 53 and 59.

Additionally, in the case where the sheet P is projected at least towards the first or second transport rollers 58 in a discharge direction, by arranging such that a part of the first and second discharge trays 53 and 59 has a surface of the same height as the first and second transport rollers 58, the discharged sheet P can be prevented from contacting the sheet P being projected, thereby preventing the discharged sheet P from being dropped from the discharge tray.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet post-processing apparatus which receives a sheet having an image formed thereon, that is discharged from an image forming apparatus according to page order, comprising:

first and second discharge trays being provided in a number of at least two;

a first transport path for guiding to said first discharge tray the sheet having an image formed thereon discharged through a sheet discharge opening of said image forming apparatus;

a branched transport path being branched from said first transport path;

a second transport path connected to said branched transport path, for guiding the sheet having an image formed thereon to said second discharge tray;

sheet transport means for transporting a sheet being transported in each transport path between a normal direction and a reverse direction, wherein said sheet transport means includes:

first transport rollers for discharging the sheet to said first discharge tray, which permits a transport direction of the sheet to be reversed, said first transport rollers being formed along said first transport path, and second transport rollers for discharging a sheet to said second discharge tray, which permits the transport direction of the sheet to be reversed, said second transport rollers being formed along said second transport path; wherein a distance between said first transport rollers and said second transport rollers is set shorter than a length of a minimum size sheet that can be processed in said image forming apparatus in a sheet transport direction; and a transport path switching member for switching the transport path for the sheet, said transport path switching member being provided at a function between said first transport path and said branched transport path.

2. The sheet post-processing apparatus as set forth in claim 1, wherein:

a member for partially waving the sheet is formed in said first and second transport path, so that a sheet projected from a main body of said sheet post-processing apparatus towards said discharge tray by at least one of said first and second transport rollers can be discharged onto said discharge tray without being buckled.

3. The sheet post-processing apparatus as set forth in claim 1, wherein:

said first and second discharge trays respectively have portions having faces formed at substantially the same height level as said first and second transport rollers respectively, so as to support a leading end portion of a sheet projected from a main body of said sheet post-processing apparatus.

4. A sheet post-processing apparatus which receives a sheet having an image formed thereon, that is discharged from an image forming apparatus according to page order, comprising:

first and second discharge trays being provided in a number of at least two;

a first transport path for guiding to said first discharge tray the sheet having an image formed thereon discharged through a sheet discharge opening of said image forming apparatus;

a branched transport path being branched from said first transport path;

a second transport path connected to said branched transport path, for guiding the sheet having an image formed thereon to said second discharge tray;

sheet transport means for transporting a sheet being transported in each transport path between a normal direction and a reverse direction, wherein said sheet transport means includes:

first transport rollers for discharging the sheet to said first discharge tray, which permits a transport direction of the sheet to be reversed, said first transport rollers being formed along said first transport path, second transport rollers for discharging a sheet to said second discharge tray, which permits the transport direction of the sheet to be reversed, said second transport rollers being formed along said second transport path, and third transport rollers for transporting the sheet in said branched transport path and permitting the transport direction of the sheet to be reversed; and a transport path switching member for switching the transport path for the sheet, said transport path switching member being provided at a junction between said first transport path and said branched transport path.

5. The sheet post-processing apparatus as set forth in claim 4, further comprising:

control means for controlling said second transport rollers to stop rotating when transporting the sheet in a reverse direction by said third transport rollers.

6. The sheet post-processing apparatus as set forth in claim 5, wherein:

a distance between said third transport rollers and said second transport rollers is set shorter than a length of a minimum size sheet that can be processed in said image forming apparatus in a sheet transport direction.

7. The sheet post-processing apparatus as set forth in claim 6, wherein:

a distance between said second transport rollers and said third transport rollers is set such that a sheet of a maximum size that can be processed in said image forming apparatus is not buckled in a state where it is projected towards said second discharge tray.

8. The sheet post-processing apparatus as set forth in claim 4, wherein:

said transport switching member selectively switches between a first switch position, at which a sheet transported from said image forming apparatus is guided to said first discharge tray and a reversed sheet transported from said first discharge tray is guided to said branched transport path, and a second switch position, at which a reversed sheet transported through said branched transport path is guided to said first discharge tray and a sheet transported from said image forming apparatus is guided to said branched transport path.

9. The sheet post-processing apparatus as set forth in claim 8, wherein:

said transport path switching member has a cross section of a substantially triangular shape having an apex corresponding to each transport path that extends from the junction at which said transport path switching member is provided, an elastic member is formed at an apex corresponding to said first transport path that extends from said junction towards a sheet discharge opening of said image forming apparatus so as to be in contact with a side face on the side of said branched transport path at a first switch position while in contact with a side face on an opposite side to said branched transport path at a second switch position, an elastic member is formed at an apex corresponding to said first transport path that extends from said junction towards said first discharge tray so as to be in contact with the side face on the opposite side of said branched transport path at the first switch position while in contact with the side face on the side of said branched transport path at said second switch position, and an elastic member is formed at an apex corresponding to said branched transport path that extends from said junction so as to be in contact with the side face on the side of said first discharge tray at said first switch position while in contact with the side face on the side of the sheet discharge opening at said second switch position.

10. The sheet post-processing apparatus as set forth in claim 4, further comprising:

a sensor for detecting a sheet, said sensor being provided in said branched transport path at its end portion in a vicinity of said first transport path; and control means for controlling said third transport rollers to rotate in a reverse direction when said sensor detects a rear end portion of the sheet being transported towards said second discharge tray via said branched transport path.

11. A post-processing apparatus which reverses a sheet having an image formed thereon, that is discharged from an image forming apparatus according to page order, comprising:

first and second discharge trays being provided in a number of at least two;

a first transport path for guiding the sheet having an image formed thereon discharged through a sheet discharge opening of said image forming apparatus to said first discharge tray;

a branched transport path being branched from said first transport path;

a second transport path connected to said branched transport path, for guiding the sheet having an image formed thereon to said second discharge tray;

sheet transport means for transporting a sheet being transported in each transport path both in a normal direction and a reverse direction;

a transport path switching member for switching a transport path of the sheet, said transport path switching member being provided at least at a junction between said first transport path and said branched transport path; and control means for controlling said sheet transport means and said transport path switching member in such a manner that a sheet being transported through said first and second transport paths is discharged onto respective discharge trays without being reversed, while reversed sheets are discharged onto respective discharge trays by utilizing said first and second transport paths as a switch back transport path by reversing the transport direction of the sheet by said sheet transport means, and that sheets are discharged onto the discharge tray as selected according to an image forming mode set in said image forming apparatus.

12. The sheet post-processing apparatus as set forth in claim 11, further comprising:

a memory for storing a discharge tray of a discharge end specified by an operator and a discharge state specified by the operator as to whether or not sheets are to be discharged after being reversed, wherein said discharge tray and the discharge state are specified by the operator.

13. The sheet post-processing apparatus as set forth in claim 11, further comprising:

a read only memory for storing a discharge tray and a discharge state of each of said image forming modes as to whether or not sheets are to be discharged after being reversed, wherein said control means controls said sheet discharge means and said transport path switching member in such a manner that the sheet is discharged based on information stored in said read only memory.

14. The sheet post-processing apparatus as set forth in claim 13, wherein:

said read only memory stores a discharge tray and a discharge state corresponding to a printer mode and a fax mode in which image data is output from an external section as a hard copy and a copy mode in which image data is output by image reading means provided in said image forming apparatus as a hard copy, and said control means controls said sheet discharge means and said transport path switching member in such a manner that the sheet is discharged based on information stored in said read only memory according to respective modes.

15. The sheet post-processing apparatus as set forth in claim 14, wherein:

said read only memory stores a discharge state of a reversed sheet in the printer mode and the fax mode, while storing a discharge state of a sheet without being reversed in the copy mode, and said control means controls said sheet discharge means and said transport path switching member so that the sheet is discharged based on information stored in said read only memory according to respective modes.

16. The sheet post-processing apparatus as set forth in claim 11, wherein:

said control means controls said sheet discharge means and said transport path switching member; wherein when discharging a sheet after being reversed, the sheet is transported to a transport path on a side of the other of said first and second discharge trays than a selected discharge tray, and then transported to said selected tray by reversing the transport direction of the sheet within said transport path.

17. The sheet post-processing apparatus as set forth in claim 11, further comprising:

a detection sensor for detecting a discharged sheet, said detection sensor being provided in each discharge tray, wherein said control means controls said sheet discharge means and said transport path switching member in such a manner that a discharge end of the sheet being transported in response to an image forming operation is set to a discharge tray at which a sheet is not detected by said detection sensor, and that the sheet is discharged as set.

18. The sheet post-processing apparatus as set forth in claim 11, further comprising:

a detection sensor for detecting a sheet discharged on each discharge tray, wherein said control means controls said sheet discharge means and said transport path switching member in such a manner that a discharge end of a sheet fed in response to an image forming operation is set to a discharge tray other than a discharge tray on which a sheet is not detected by said detection sensor, and a sheet is discharged after being reversed using the discharge tray on which a sheet does not exist to be discharged onto said discharge tray of the discharge end.

19. A sheet post-processing apparatus which receives a sheet having an image formed thereon, that is discharged from an image forming apparatus according to page order, comprising:

first and second discharge trays being provided in a number of at least two;

a first transport path for guiding to said first discharge tray the sheet having an image formed thereon discharged through a sheet discharge opening of said image forming appratus;

a branched transport path being branched from said first transport path;

a second transport path connected to said branched transport path, for guiding the sheet having an image formed thereon to said second discharge tray, said second transport path being connected to a retransport path that is used when said image forming apparatus carries out a double-sided copying operation or a composite copying operation;

sheet transport means for transporting a sheet being transported in each transport path both in a normal direction and a reverse direction, wherein said sheet transport means includes:

first transport rollers for discharging the sheet to said first discharge tray, which permits a transport direction of the sheet to be reversed, said first transport rollers being formed along said first transport path, second transport rollers for discharging a sheet to said second discharge tray, which permits the transport direction of the sheet to be reversed, said second transport rollers being formed along said second transport path, and third transport rollers for transporting the sheet in said branched transport path and permitting the transport direction of the sheet to be reversed;

transport path switching members for switching a sheet transport path, said transport path switching members being provided at a junction between said first transport path and said branched transport path, and a junction between said second transport path and said branched transport path; and control means for controlling said sheet discharge means and said transport path switching members in such a manner that a sheet is fed into said retransport path so that a next image is formed on the back surface of the surface on which the previous image is formed when said image forming apparatus carries out a double-sided copying operation, while a sheet is fed into said retransport path so that the next image is formed on the surface whereon the previous image is formed when said image forming apparatus carries out a composite copying operation on the same surface of the sheet.

20. A sheet post-processing apparatus which receives a sheet having an image formed thereon, that is discharged from an image forming apparatus according to page order, comprising:

first and second discharge trays being provided in a number of at least two;

a first transport path for guiding to said first discharge tray the sheet having an image formed thereon discharged through a sheet discharge opening of said image forming apparatus;

a second transport path formed so as to face said first transport path, for guiding the sheet having an image formed thereon to said second discharge tray;

a branched transport path for connecting said first transport path and said second transport path;

sheet transport means for transporting a sheet being transported in each transport path between a normal direction and a reverse direction;

a transport path switching member for switching the transport path of the sheet, said transport path switching member being provided at a junction between said first transport path and said branched transport path; and control means for controlling said sheet transport means and said transport path switching member in such a manner that a sheet transported through said first and second transport path is discharged onto respective discharge trays without being reversed, while a reversed sheet is discharged onto each discharge tray utilizing said first and second transport paths as a switch back transport path by reversing a transport direction of a sheet being transported by said sheet transport means, and that the sheet is discharged onto the discharge tray as selected according to an input device for inputting image data when said image forming apparatus performs an image forming operation.

* * * * *